United States Patent [19]

Breitenstein et al.

[11] 4,068,414

[45] Jan. 17, 1978

[54] AUTOMATIC FLUTE GRINDING MACHINE

[75] Inventors: Charles Thomas Breitenstein, Elk Grove Village; Allen Roland Holecek, Rockton, both of Ill.

[73] Assignee: Spiral Step Tool Company, Elk Grove Village, Ill.

[21] Appl. No.: 789,991

[22] Filed: Apr. 22, 1977

Related U.S. Application Data

[63] Continuation of Ser. No. 697,558, June 18, 1976, abandoned.

[51] Int. Cl.[2] ..... B24B 3/24

[52] U.S. Cl. ..... 51/95 LH; 51/232; 51/288

[58] Field of Search ..... 51/165 R, 165 TP, 165.77, 51/165.71, 95 LH, 232, 288

[56] References Cited

U.S. PATENT DOCUMENTS

| | | | |
|---|---|---|---|
| 2,850,849 | 9/1958 | Babbitt | 51/95 LH |
| 3,344,559 | 10/1967 | Inaba | 51/165 TP |

*Primary Examiner*—Harold D. Whitehead
*Attorney, Agent, or Firm*—Callard Livingston

[57] ABSTRACT

An automatic grinding machine adapted to cut and relieve spiral drill flutes and perform analogous form-relieving operations requiring helical advance of the work, wherein a linearly-moving carriage travels a rotary spindle and its work chuck relative to a grinding wheel in programmed duty cycles under control of logic circuitry with optional manual override control. Separate electric motors for the carriage and spindle are activated at adjustable speed ratios by digitally set binary drive pulses enabling instant change of helix angle or lead ratios and other working parameters by adjustment of digital switches at a simple control panel. A reversible tool head affords automatic cross-cutting capabilities; and a system of pulse-controlled indexing of the work is provided to increase the production rate of the machine by a method which effects the indexing as a function of the otherwise idle return travel of the carriage for restarting in successive work excursions.

20 Claims, 43 Drawing Figures

WHEEL RELAY
CYCLE
WHL ON
WHL OFF
SPEED FWD.
REV.
LOAD PLUNGER
RETRACT (UNLOAD)
FWD. (LOAD)
LOAD FWD.
RETURN
TOOL HEAD
STEADY REST
WHEEL UP
DN.
JOG FWD.
REV.
CHUCK
CHUCK OP.
CLO.
MODE
MAN.
AUTO.
S.S.
SPINDLE
INDEX NO.
TABLE
INDEX DIST.
LOGIC & SUBCIRCUITS
BACK
FWD.
MC-I
MC-II

FIG. 3
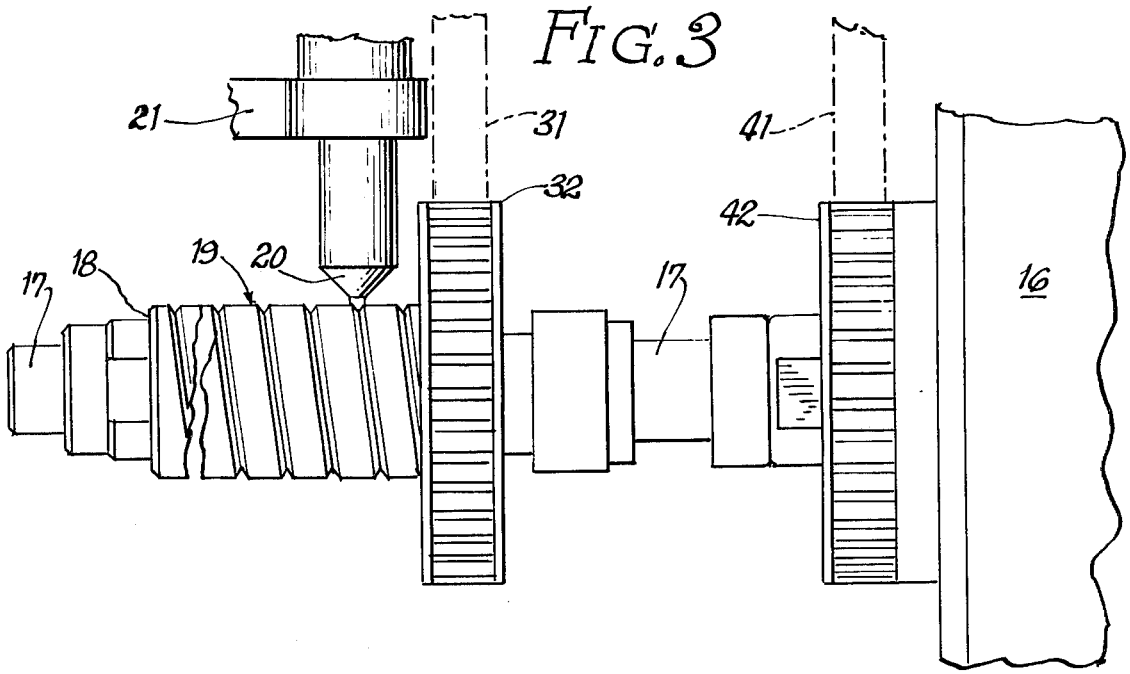
FIG. 4
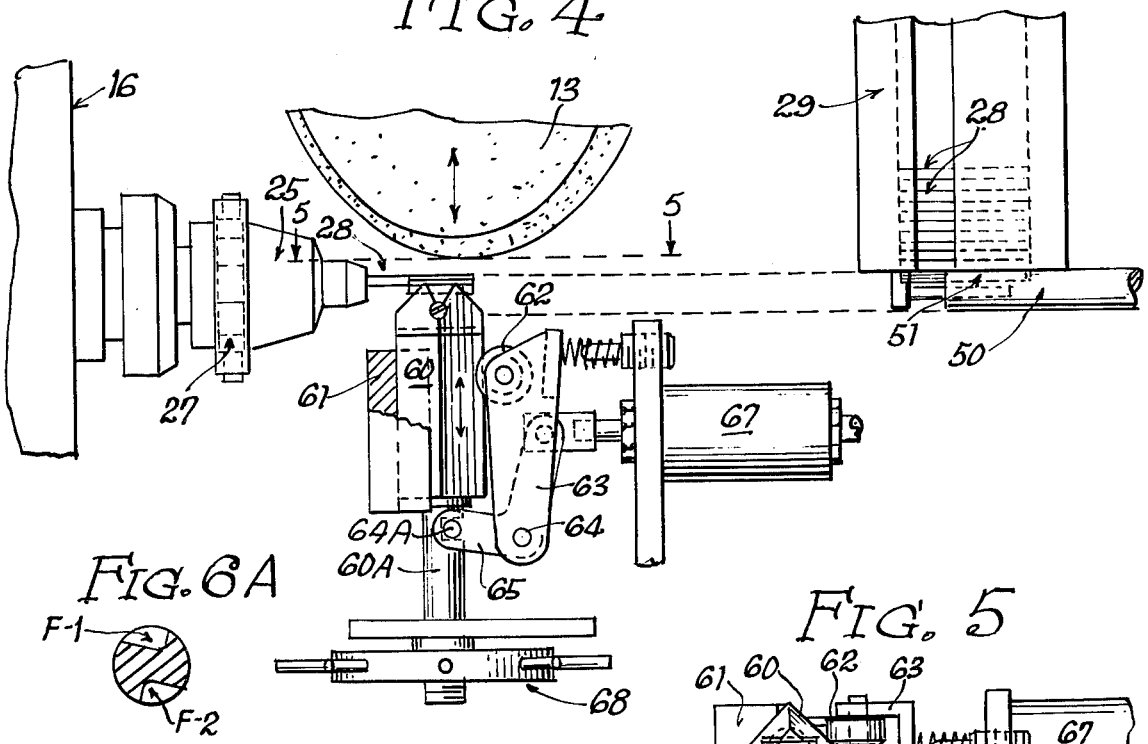
FIG. 6A
FIG. 5
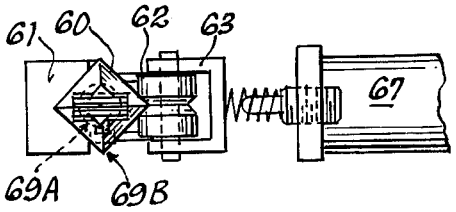
FIG. 6
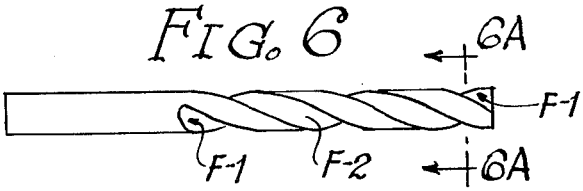

FIG. 5-A

MANUAL SWITCHES
SOLENOID DRIVERS
TO FIG. 8 LOGIC
LIMIT SWITCHES
+12V. +5V.
CARRIAGE
LOAD CYL.
Z50A UNLOAD
Z50B LOAD
Z50C CHK. OPN.
Z50D CHK. CLD.
Z50E ST. REST UP
Z50F WHEEL ON
WHEEL DWN.
+12V.
WHEEL RELAY
WHEEL ON
Z-1
Z-43
Z-38
S/S
STEP BY STEP
LOAD
UNLOAD
FWD
REV.
WHEEL UP
WHEEL DN.
CHK OPN.
CHK CLD.
CYCLE
AUTO LOAD
MAN. AUTO.
Z-2 A
Z-2 B
Z-2 C
Z-2 D
FWD.
RET.
70
75A
75B
76
77A
77B
78
78A
90A
90B
92A
92B
93A
93B
94A
94B
22
23
57
58

FREQUENCY GEN.

FREQUENCY DIVIDER
--CARRIAGE--
SAMPLE PULSE
Z-45A
TIMER
10DNS
Z-8 A
Z-46 SYNC. CLOCK
Z-53 SYNC. CLOCK
Z-47
Z-54
Z-25
Z-37F
INVERSE COUNT TO FIG. 12
ARBITRATION (FIG. 20)
(B-4)
(A3)
(B27) (B28) (B29) (B30)
10°
(B23) (B24) (B25) (B26)
10¹
THUMBWHEEL INPUTS
Z-37
(B-4)
10Z-L
Z-31 A
Z-12
BLANK -L-
Z-38 B
WAIT
(19)
HIGH-H
Z-37E
REV-H
(B3)
Z-38A
Q5
Q12
Z-34 B
Z-34 A
Z-17B
Z-17A
(B8)
(B9)
-REV.-L
-FWD.-L-
TO TRANSLATORS
e.g. FIGS. 14-15
COUNT (FROM FIG. 10)
-L-
(A3)
BLANK
-L-
REV.
-H-
(B31)
FWD.
-H-
(B29)

FREQUENCY DIVIDER -- SPINDLE --
COUNT -L-
COUNT -I-
10DNS
Z-45B
Q
SAMPLE PULSE
Z-8 B
10MS
Z-52
TIMER
BLANK -L-
112
FWD -H-
Z-55
R-STEP -H-
REV.-H
Z-34 D
Z-34 C
REV.-H-
Z-24B
Z-24A
R. STEP -H-
HIGH
-REV. (A8)
-FWD. (A9)
TO TRANSLATORS FIGS 14 & 15
Z-32 DECADE COUNTR.
CLR.
CLK
INV.COUNT -H-
Z-39 DECADE COUNTR.
Z-26-D
Z-26A
Z-25A
Z-33 COMPARATOR
Z-40 COMPARATOR
Z-31 B
10Z-L
(B5)
CLOCK FROM INV. COUNT FIG 11
ARBITRATION
TO FIG 10
(A27) (A28) (A29) (A30)
10°
(A23) (A24) (A25) (A26)
10¹
THUMBWHEEL INPUTS

INDEX LOGIC
114
BLANK
-Z-
+5V
113
Z-8 A
Z-9F
Z-2F
ONE-SHOT TIMER
100NS
HIGH
BLANKING
Z-8 B
-H-
STEP
SPINDLE
107
Z-1
CLK
SET
Z28 A
HIGH
R. STEP-H-
INDEX-H-
(A4)
AUTO-L
(A5)
Z-4 DECADE COUNTR
Z-5
Z-6
Z-7 DECADE COUNT'R
Z-12E
Z-12B
Z-12A
Z-13F
Z-13D
Z-13C
Z-9E
Z-9D
Z-9A
Z-18 COMPARATOR
Z-19
Z-20
Z-21 COMPARATOR
(A14) (A15) (A16) (A17)
(A10) (A11) (A12) (A13)
(B14) (B15) (B16) (B17)
(B10) (B11) (B12) (B13)
115
FROM INDEX DIST. SW. 73
COUNTERS
INVERTERS
COMPARATORS

FIG. 16-10°
(B28)
(B29)
(B30)
(B31)
INDEX PASS
COUNTER
COUNT OUT-H-154
COMPARATOR
Z-54
Z40B TO E
B
C
D
E
DECADE COUNTER
Z-47
Z-44
FWD. FL-FL-L-
Z-40A
DONE
H
AUTO-H-

FLUTE & PASS COUNTING

VELOCITY REFERENCE

AUTOMATIC FLUTE GRINDING MACHINE

This is a continuation of application Ser. No. 697,558, Filed June 18, 1976 and now abandoned.

Various arrangements are known for imparting complex linear and rotary motion to a work piece, as by travelling a slide table or carriage upon which the work spindle is being rotated simultaneously in progression relative to a cutting wheel to produce a spiral trace, as for example in forming spiral flutes on drill bodies, reamers, routers, and the like.

The requisite linear and angular drive components for producing such complex work motion may be derived according to known practices from a single driving motor in conjunction with various kinds of power take-off mechanism involving gearing, cams, sine drives and like arrangements to divide the driving torque into linear and angular components; or, in accordance with another method, separate driving motors may be employed to avoid some of the mechanical difficulties inherent in the unitary motordrive systems. Error potential exists in both systems, however; and in the case of the more preferential multiple-motor type of drive, difficulty is encountered in maintaining a constant driving speed in the several motors which becomes particularly critical in precision work or where the workig load on the motors is heavy and higher spindle speeds are required.

In accordance with the present disclosures, separate pulse-actuated motors are employed to drive the carriage and spindle under control of digitally-set binary drive pulses affording selectably pre-set speed ratios determinative of the various helix or lead angles required to be imparted to the work as it progresses relative to the grinding wheel.

In accordance with further aspects of the disclosures, automatic indexing of the work to new starting positions during any duty cycle, as in grinding multiple flutes each beginning at a certain angular distance away from other flutes abut the drill body, is effected during the otherwise lost-time return travel of the carriage back to its home position, preparatory to restarting in the next working pass, by a method which stops the spindle without extinguishing the drive pulses while counting and comparing the pulses for both carriage and spindle, and subsequently restarting the spindle while the carriage is advancing the work toward the wheel and at a certain point in such advance designated as the "Index Distance" which is a measure in terms of pulses needed to bring the work into engagement with the grinding wheel at the precise index or starting position required.

In accordance with still another aspect of the improvements, the tool head is pivotable from one angular cutting position to another crosswise of the spindle and work axis to perform reverse fluting and cross-cutting operations automatically under control of pesettable digital switch means along with the setting of other working parameters at the control panel.

The detailed nature of foregoing and other distinguishing aspects of novelty and utility characterizing the improvements will appear more fully from the following description of preferred illustrative embodiments of the machine taken in view of the annexed drawings in which:

FIG. 3 is an enlarged fragmentary front elevational detail showing parts of the work spindle and the carriage tracking sleeve and coupling thereof with their respective driving motors;

FIG. 4 is an enlarged fragmentary detail in vertical elevation of the spindle chuck, tool rest, blank-feeding magazine and chuck-loading plunger mechanism with parts shown in section;

FIG. 5 is a top plan detail of parts of the tool rest structure as viewed along lines 5—5 of FIG. 4; FIG. 5-A is an elevational detail of the same.

Figure 1:
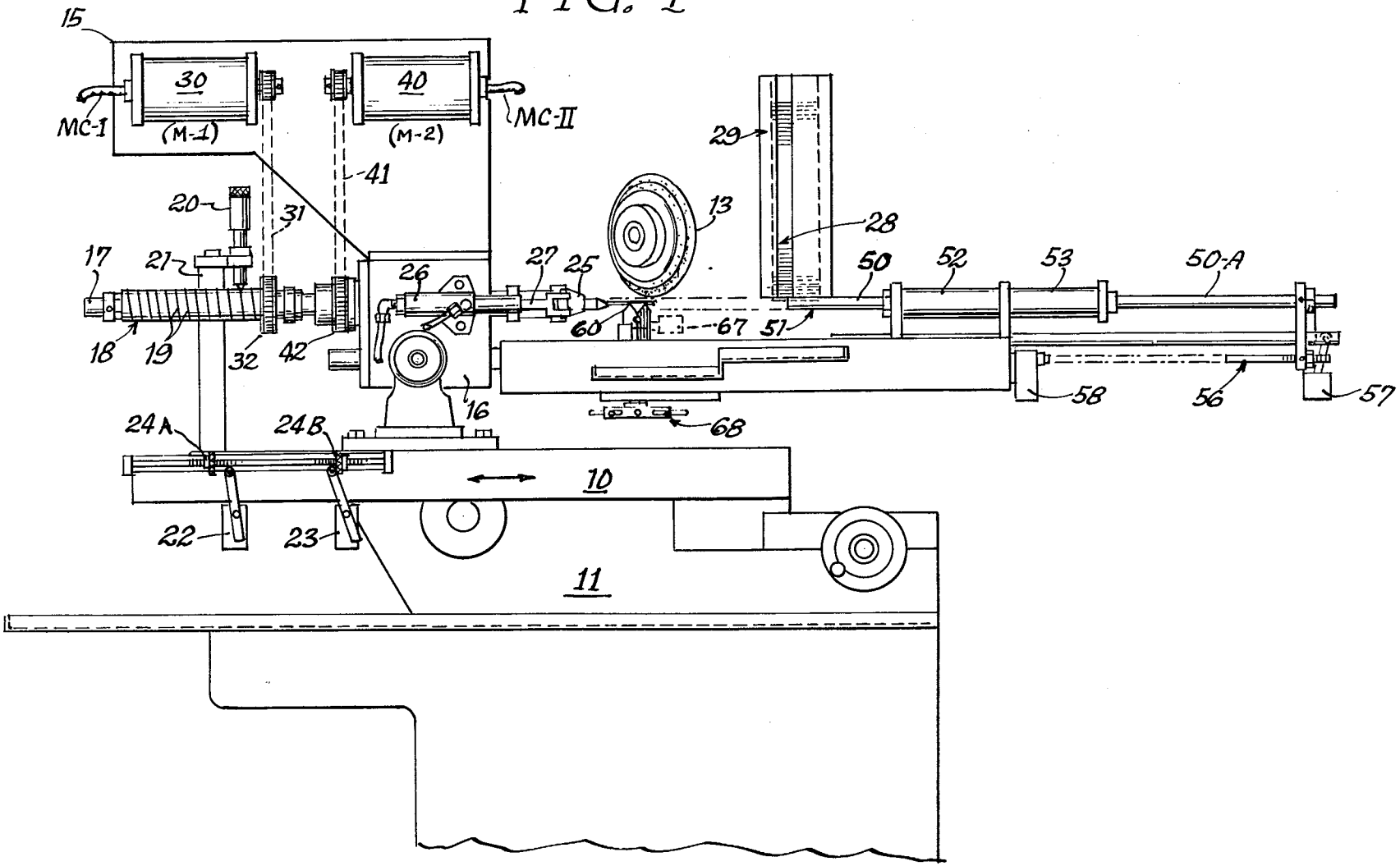
FIG. 1 is a front elevation of the flute grinding machine with manually-set grinding head.
Figure 2:
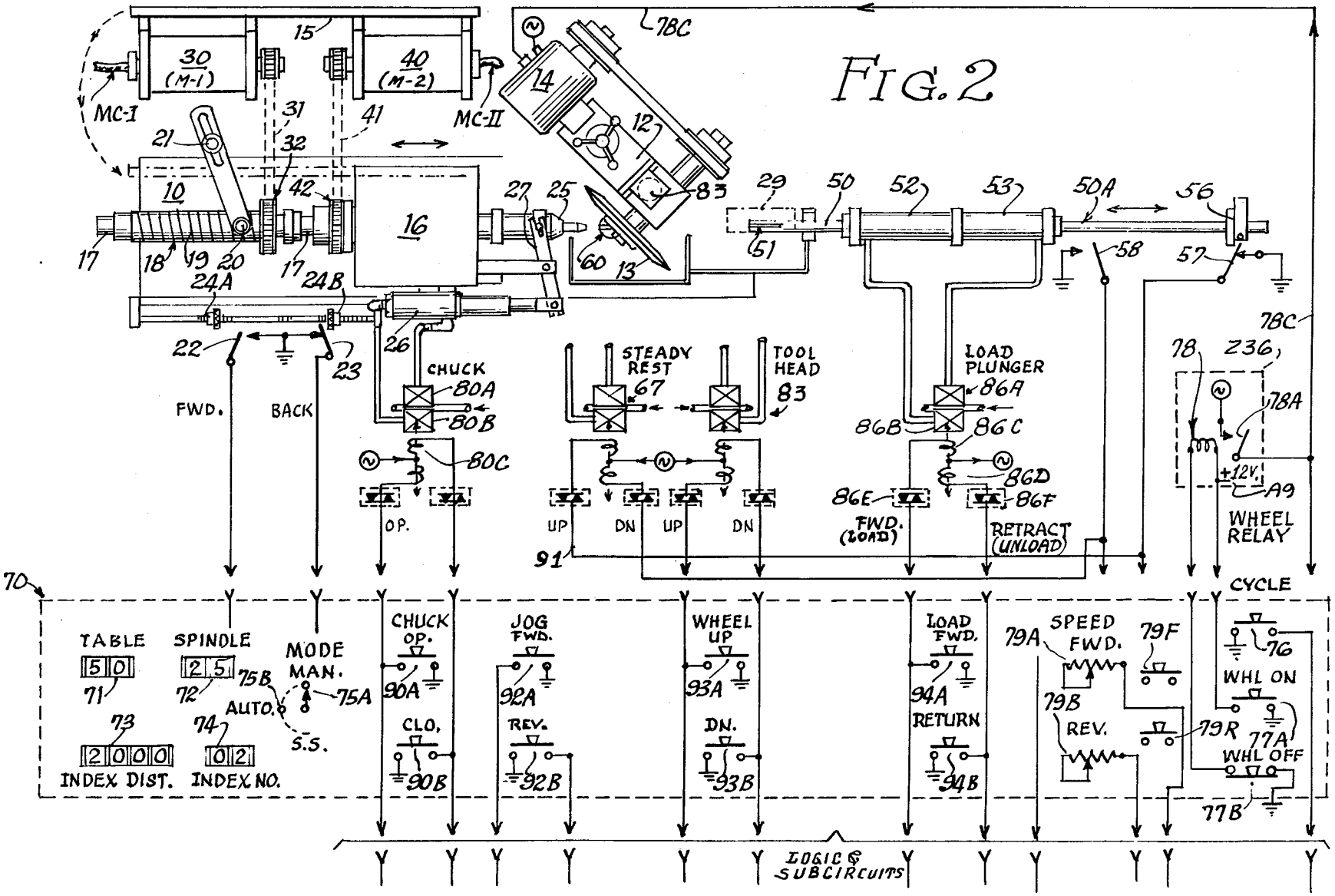
FIG. 2 is a top plan view of parts of the machine of FIG. 1 with schematic showing of pneumatic actuators and appurtenant control valves, limit switches and circuit components.
Figure 7:
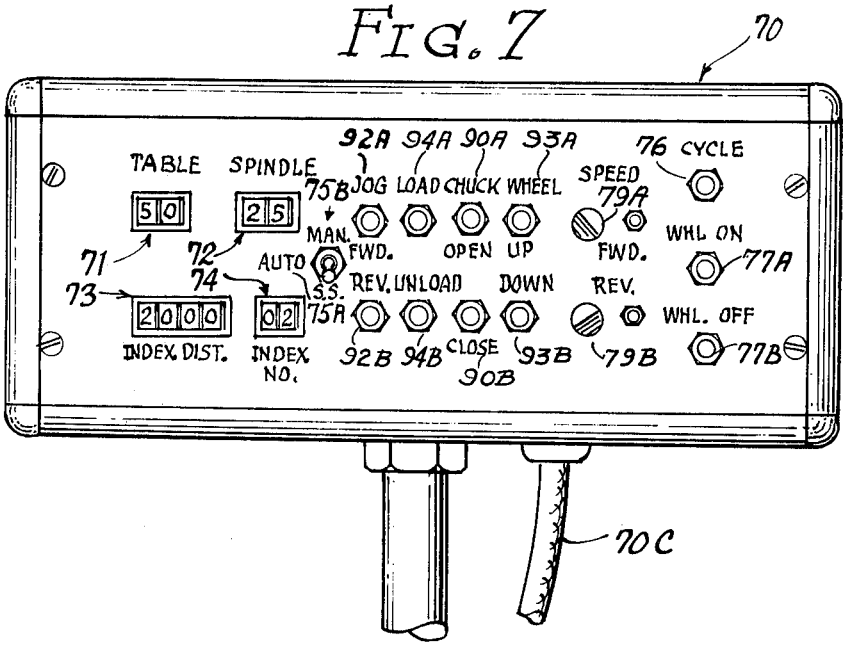
Figure 7:
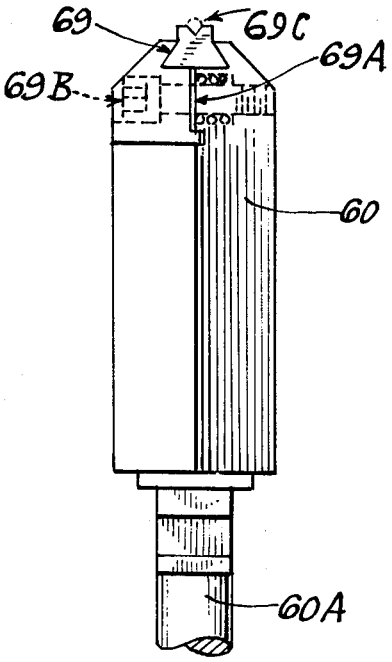
Figure 8:
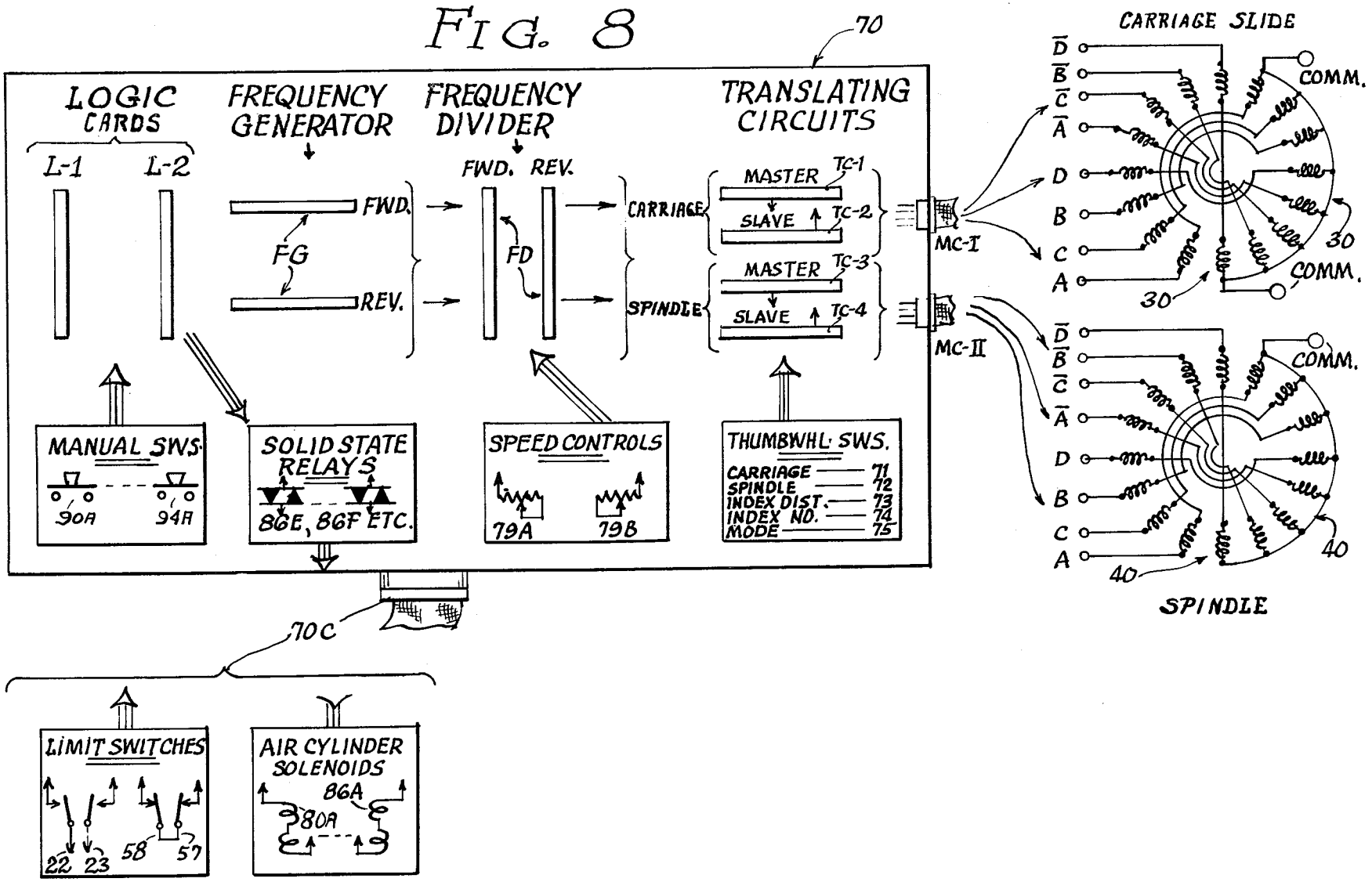
Figure 9:
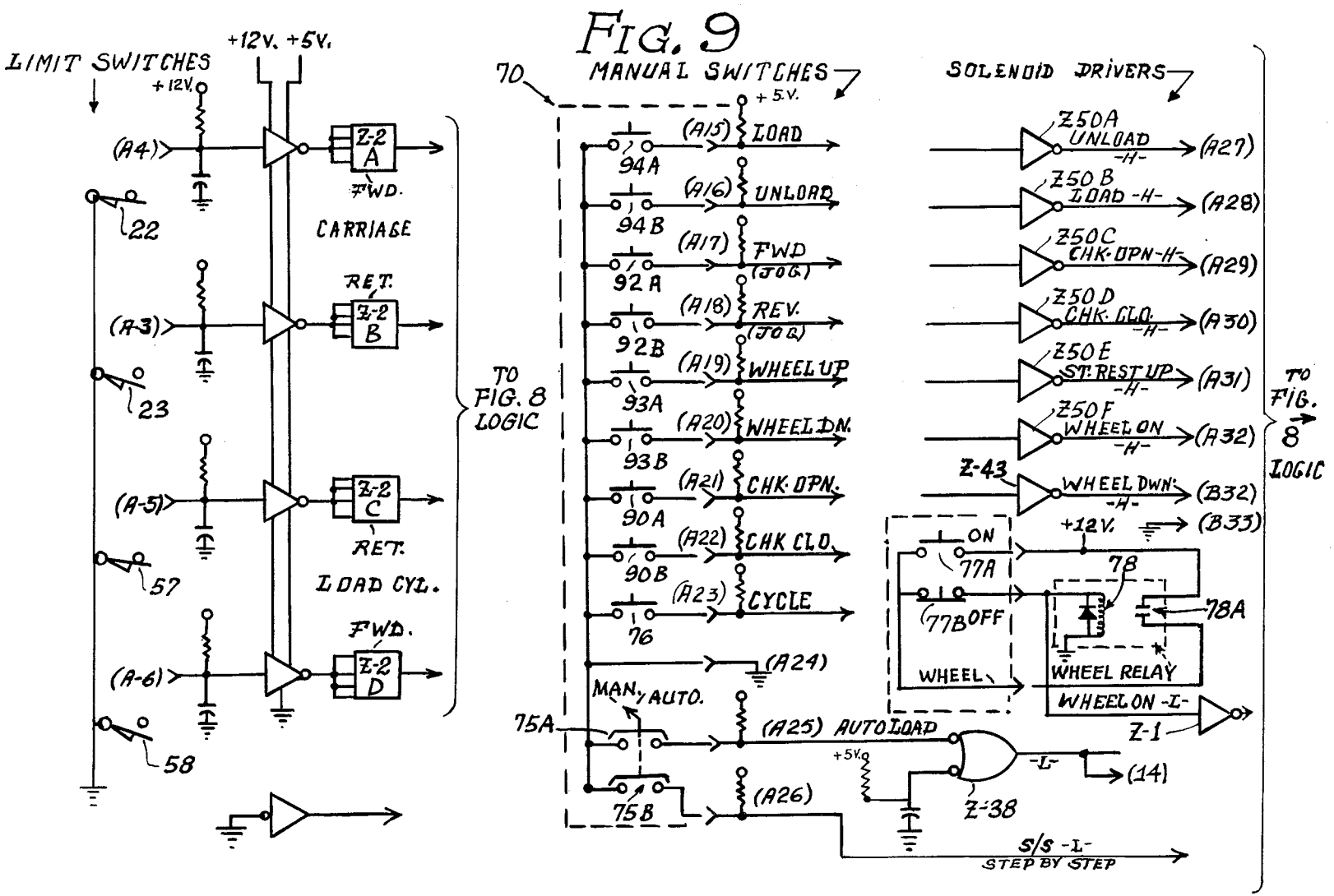
Figure 10:
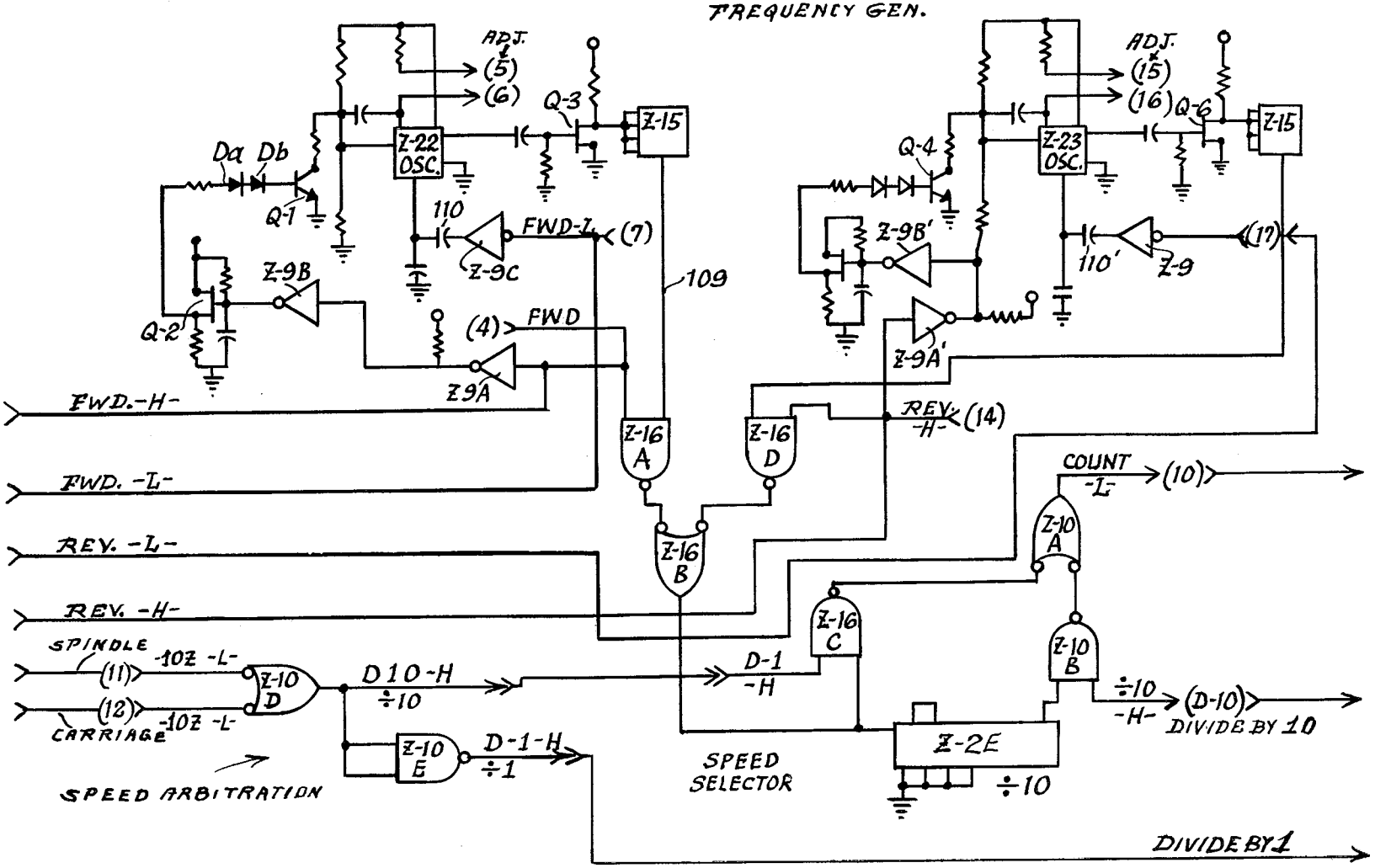
Figure 11:
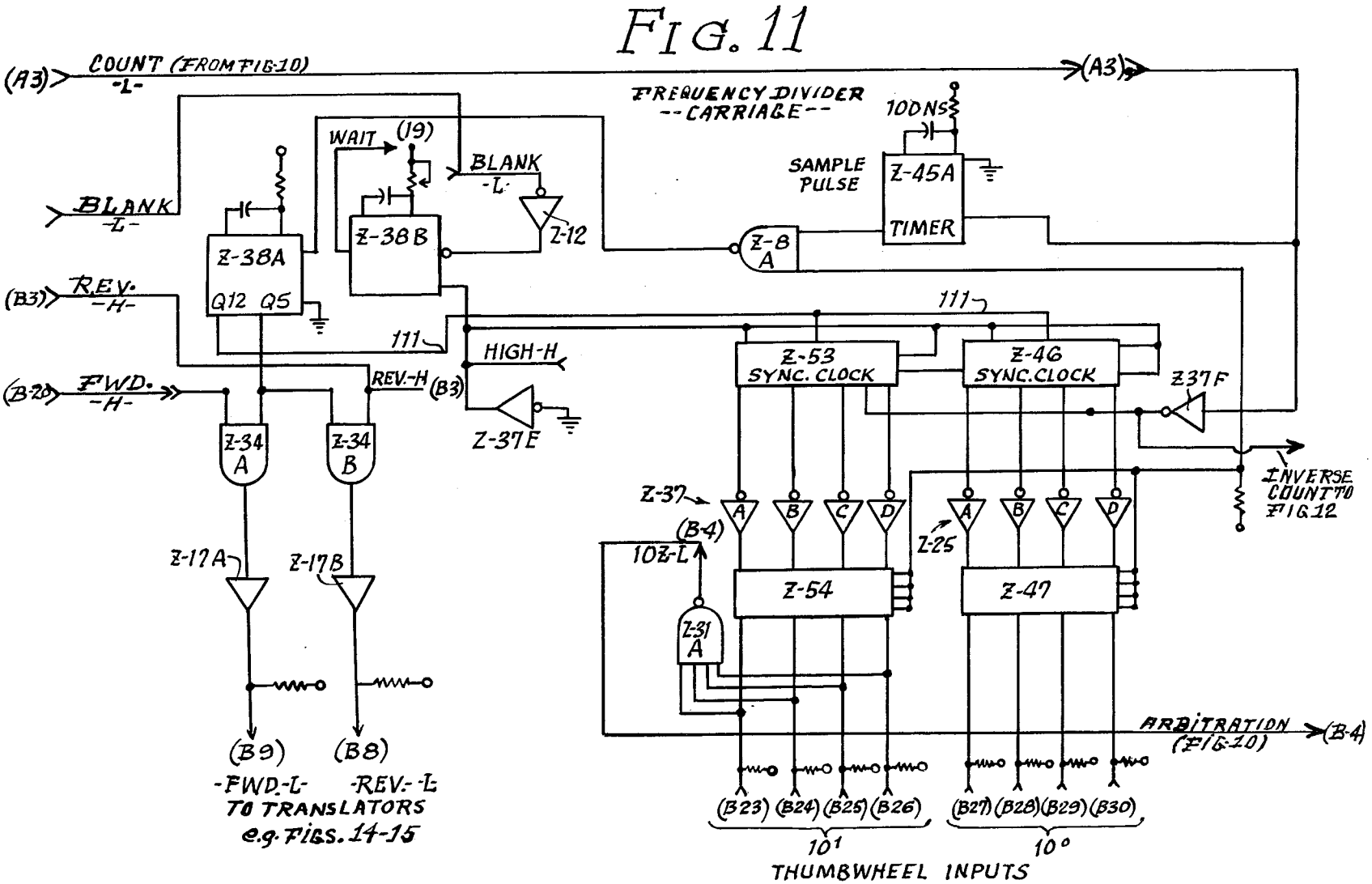
Figure 12:
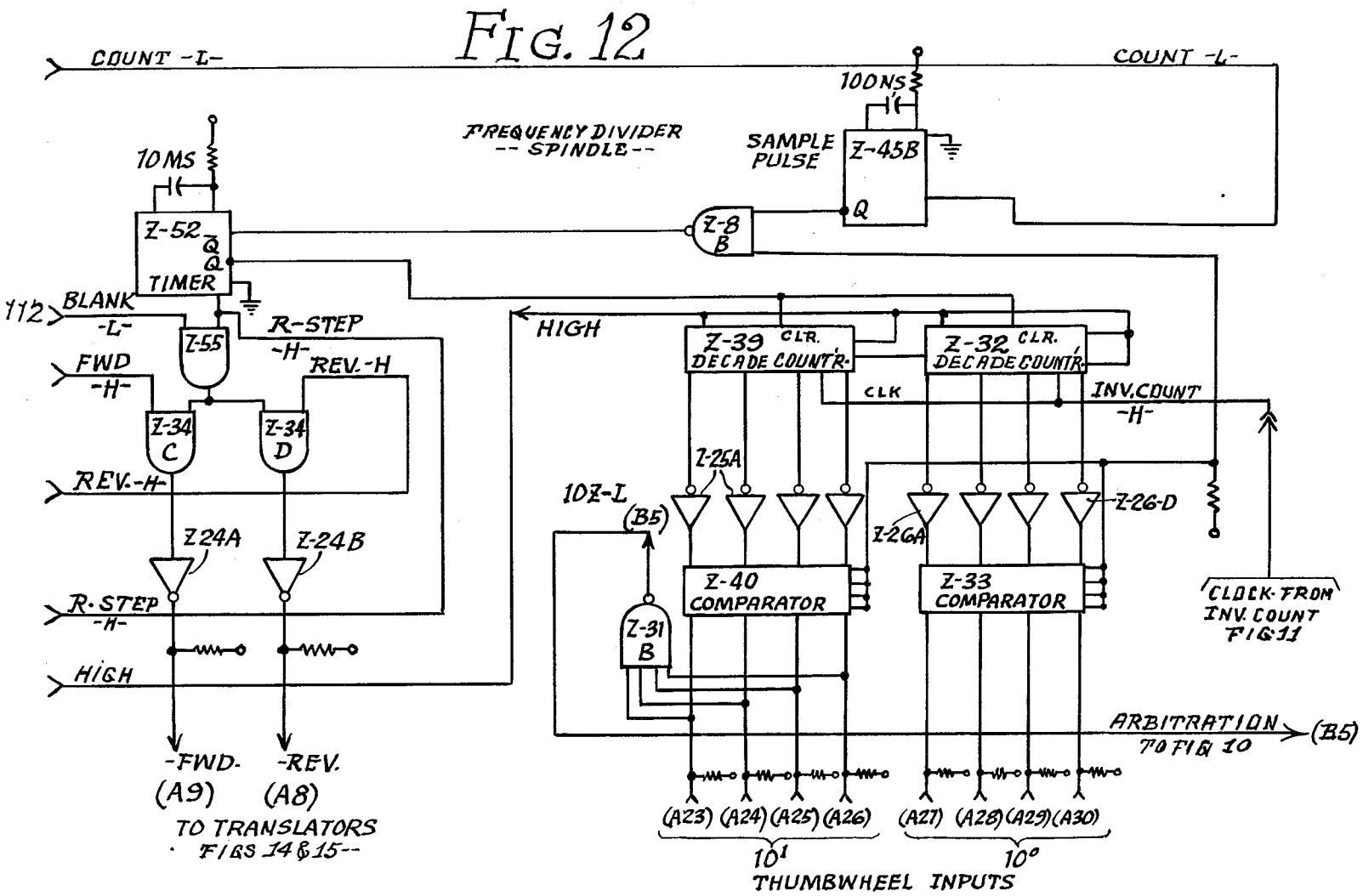
Figure 13:
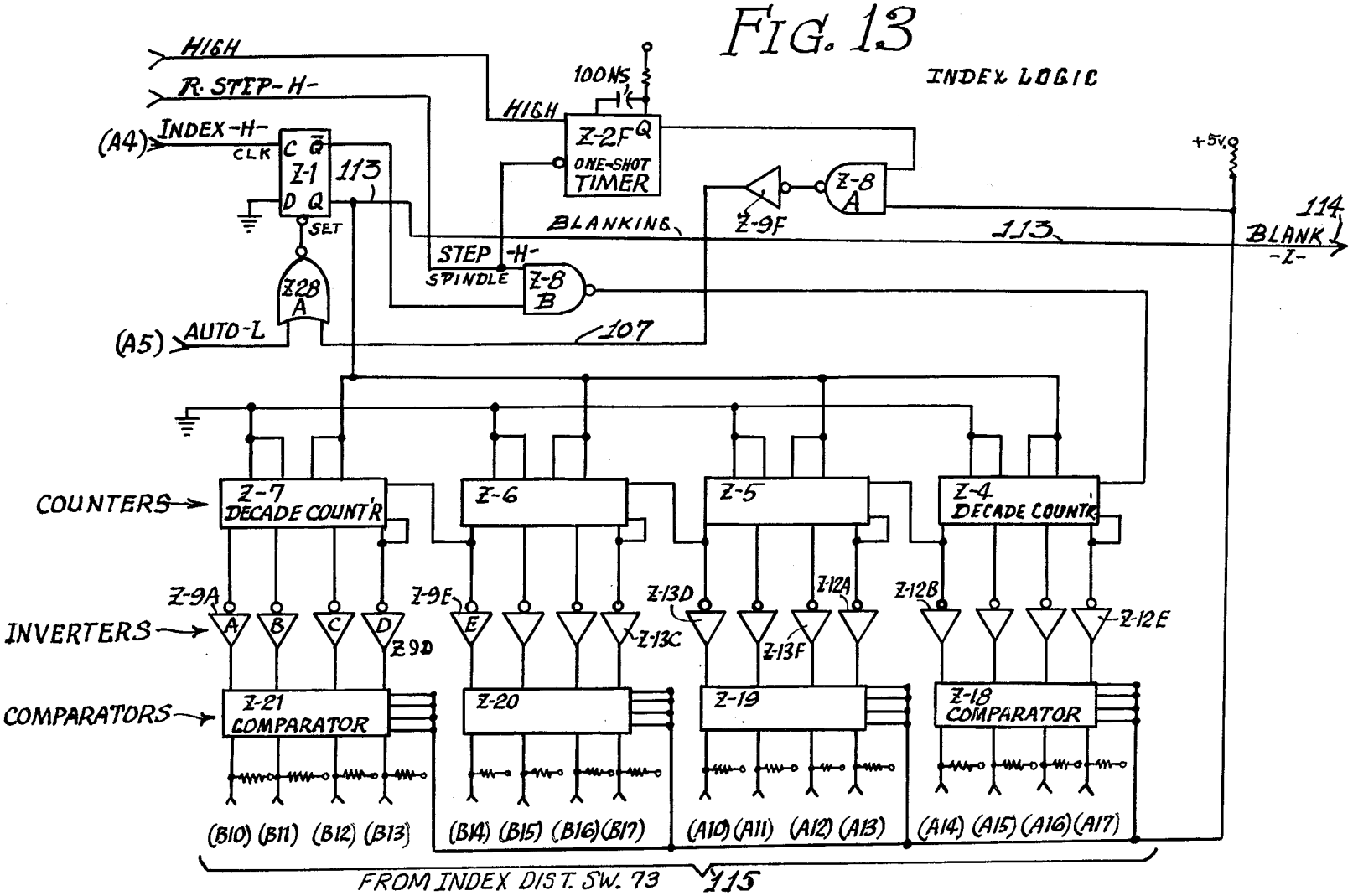
Figure 14:
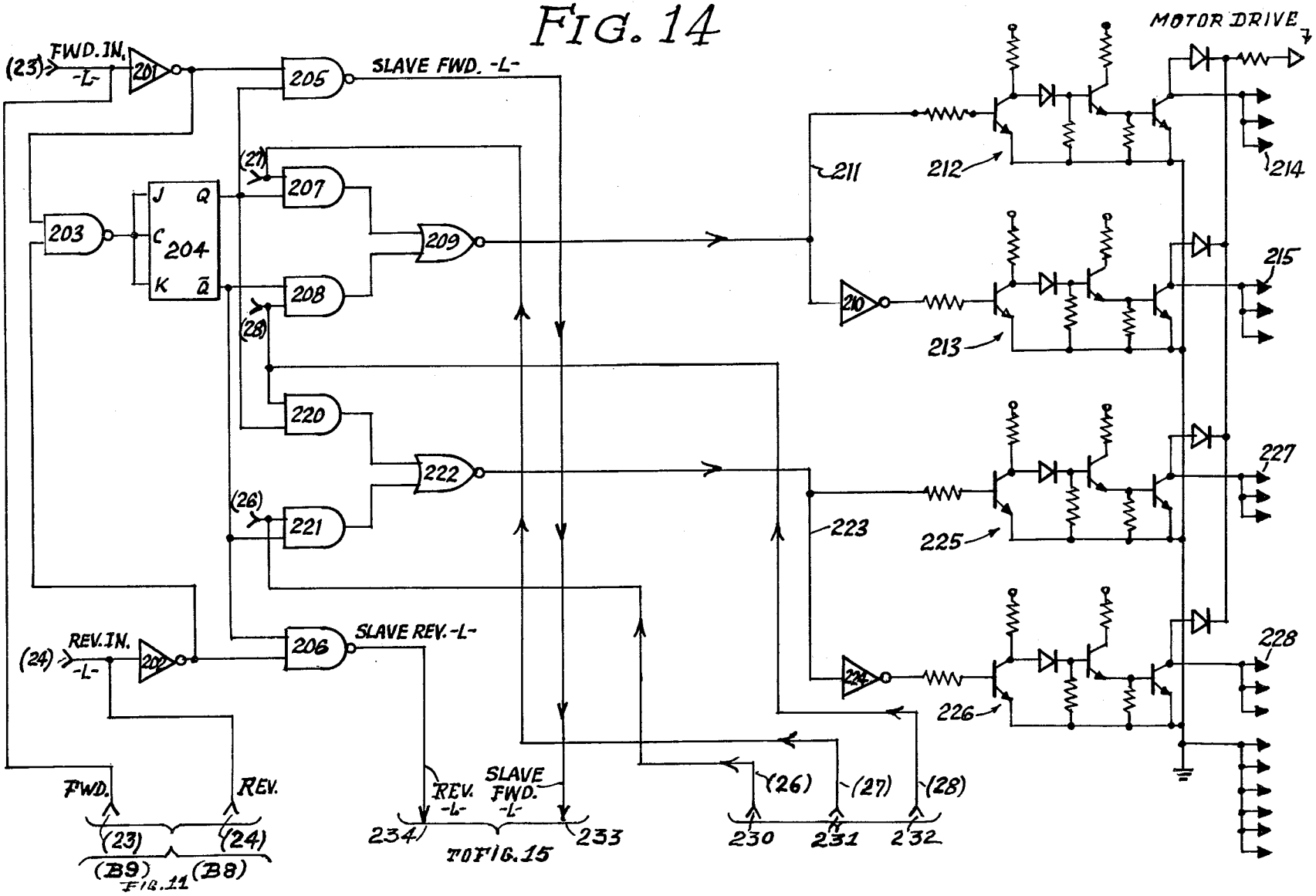
Figure 15:
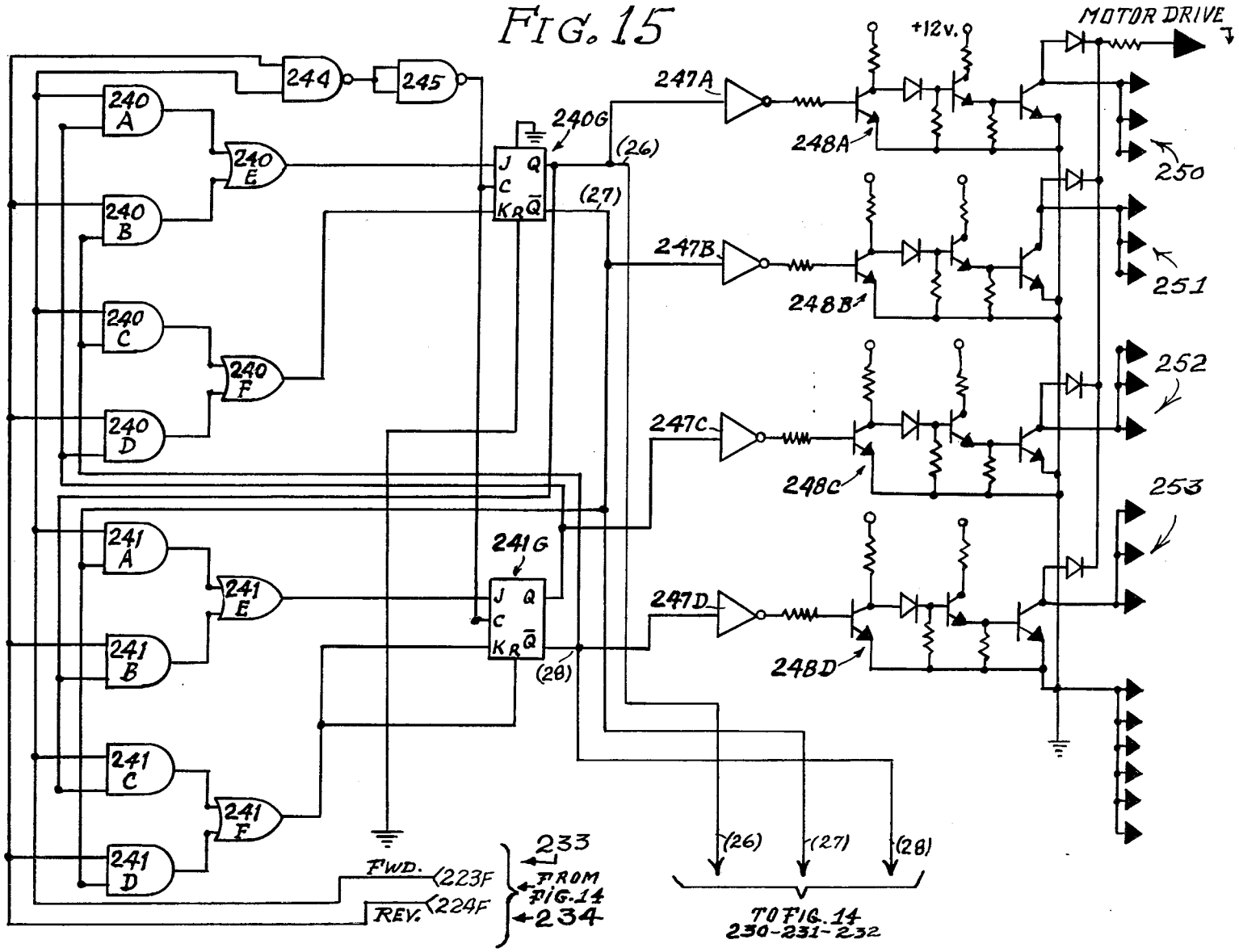
Figure 16A:
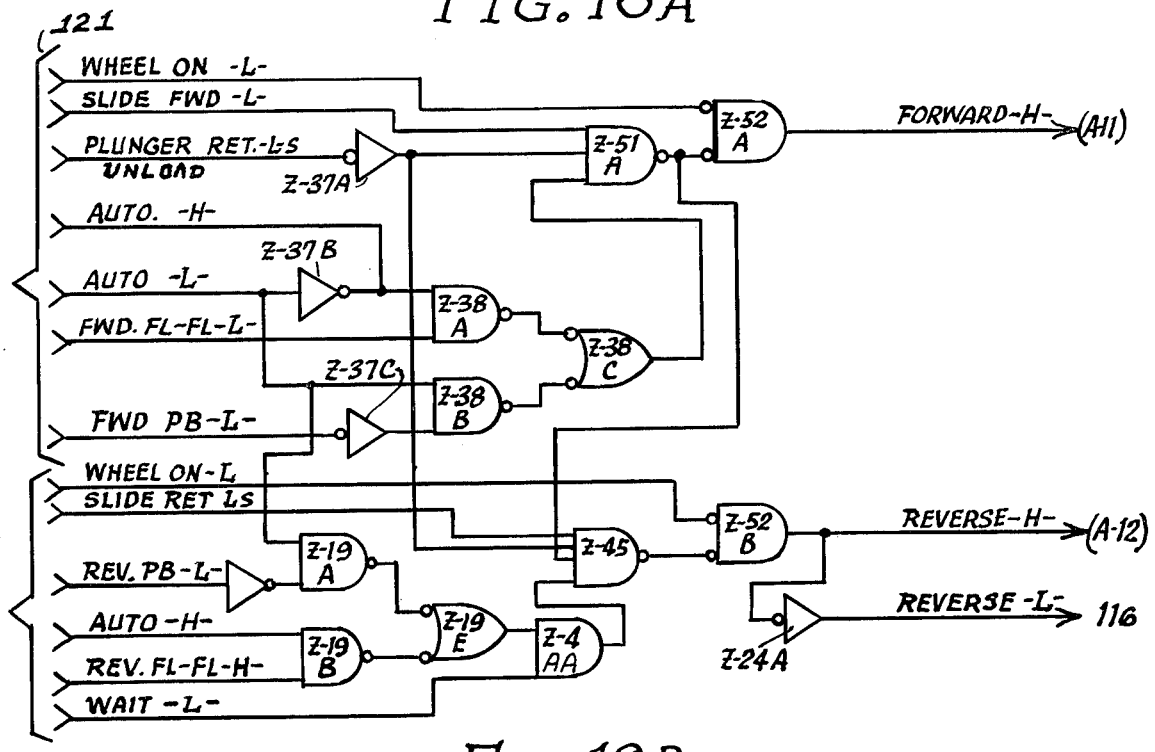
Figure 16B:
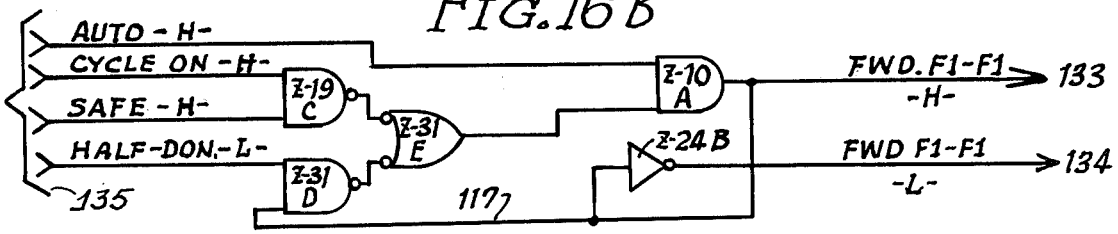
Figure 16C:
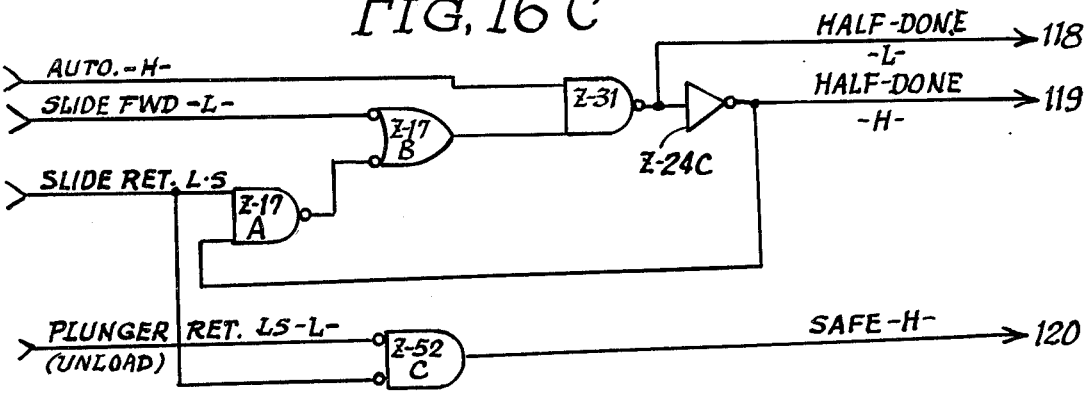
Figure 16D:
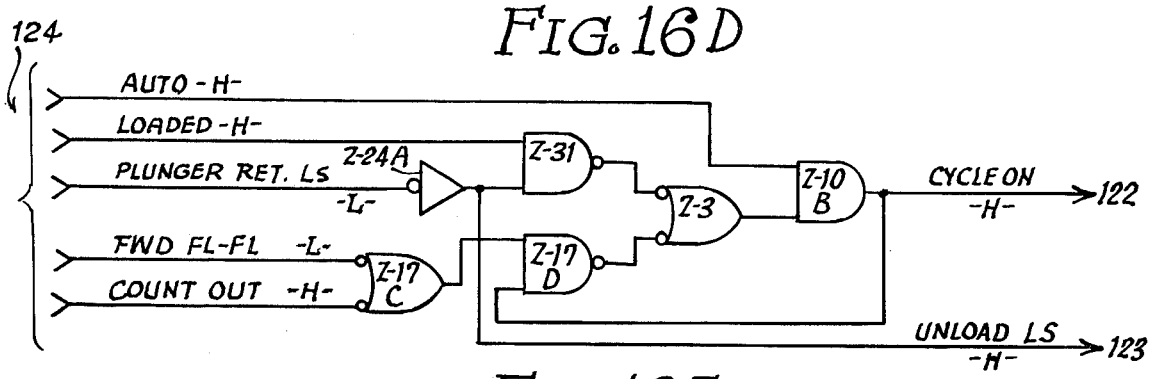
Figure 16E:
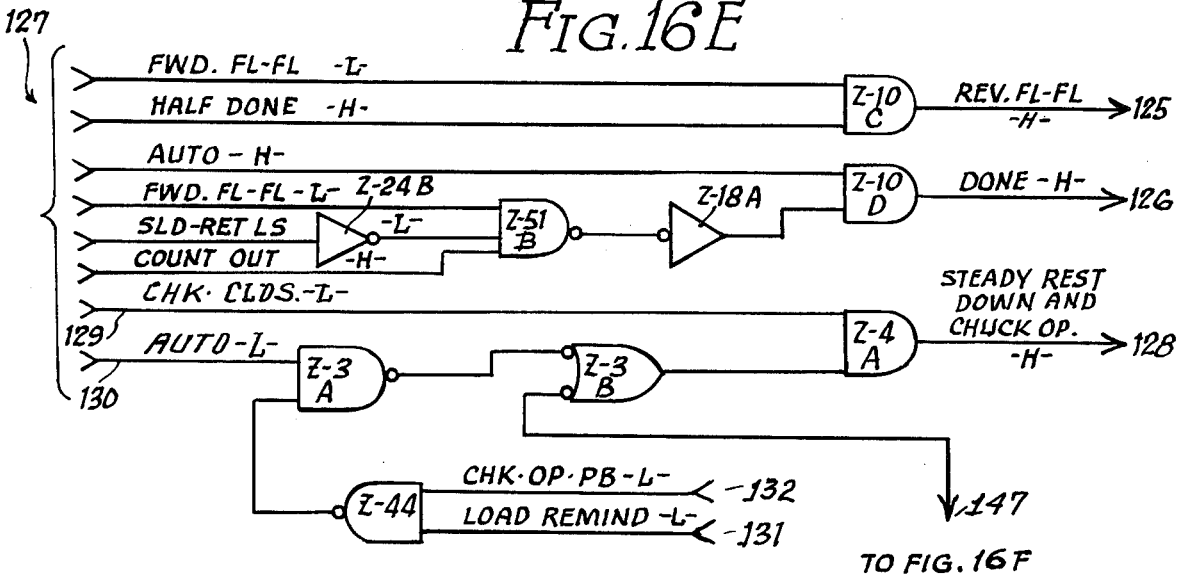
Figure 16F:
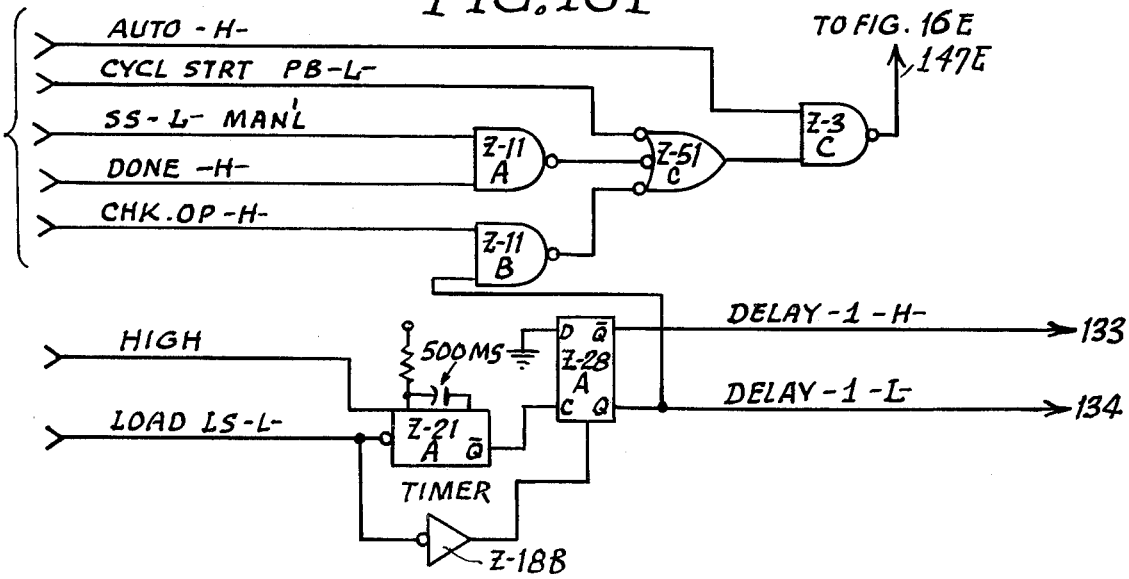
Figure 17A:
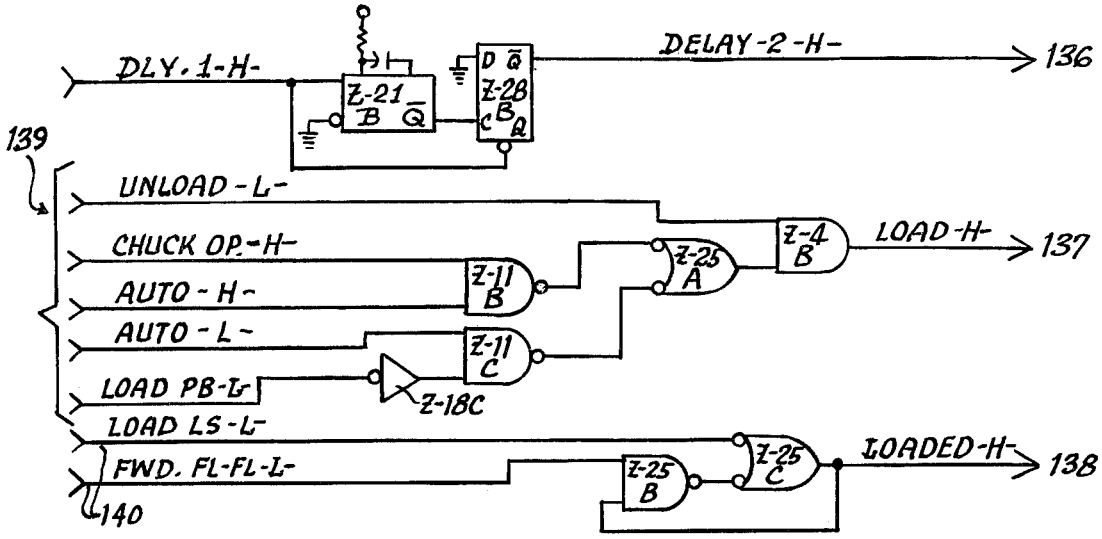
Figure 17B:
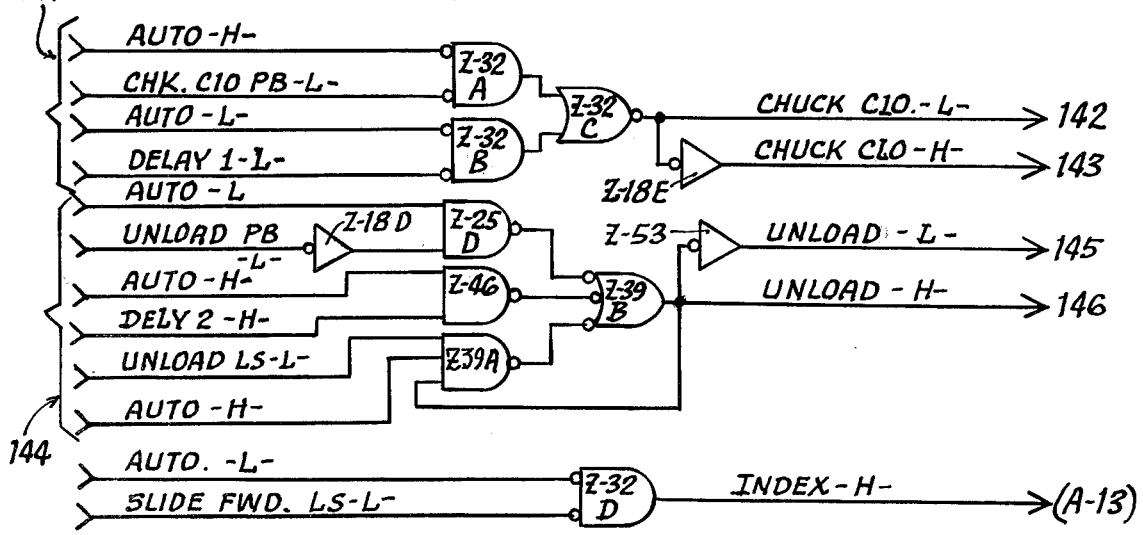
Figure 17C:
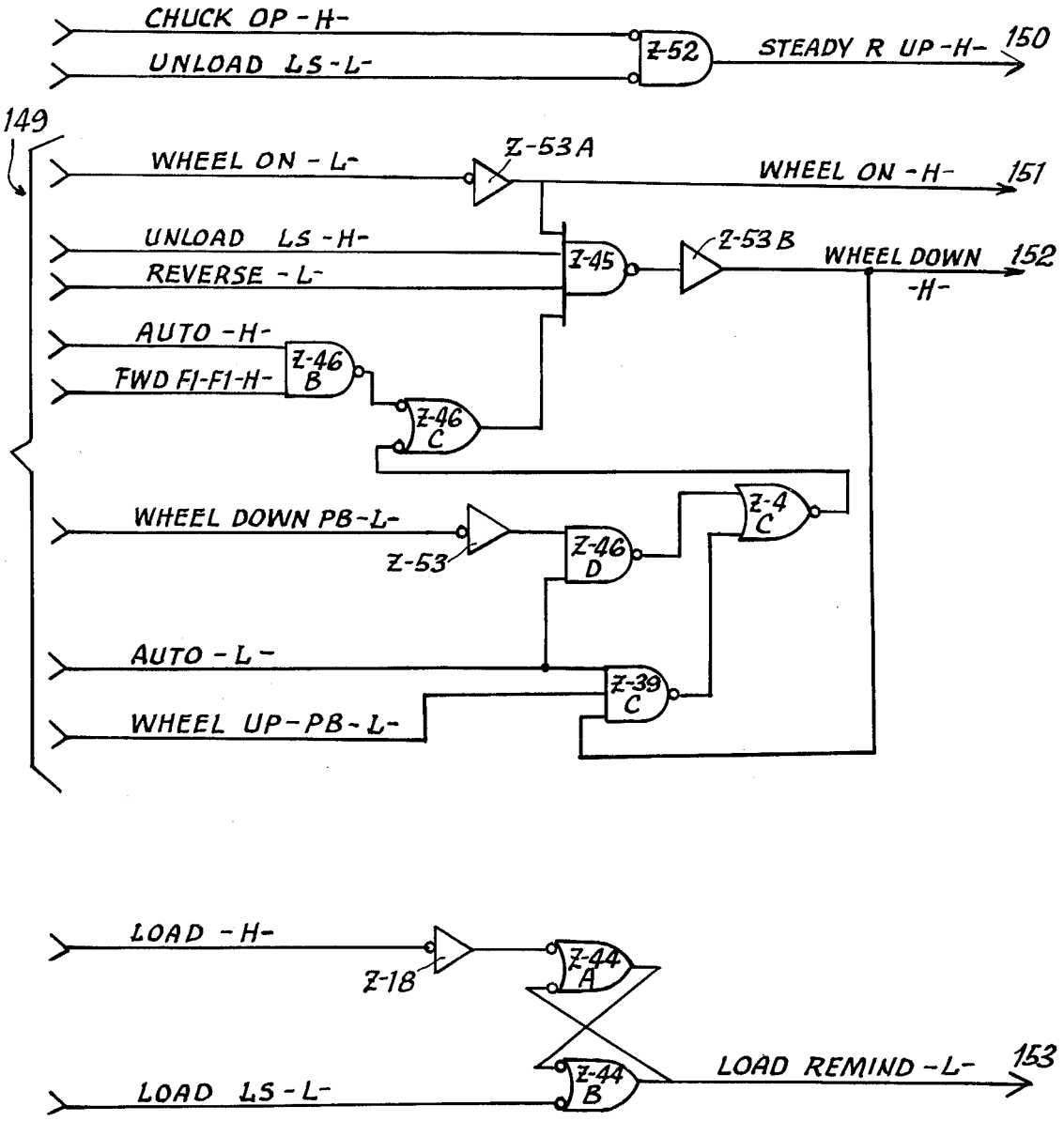
Figure 18:
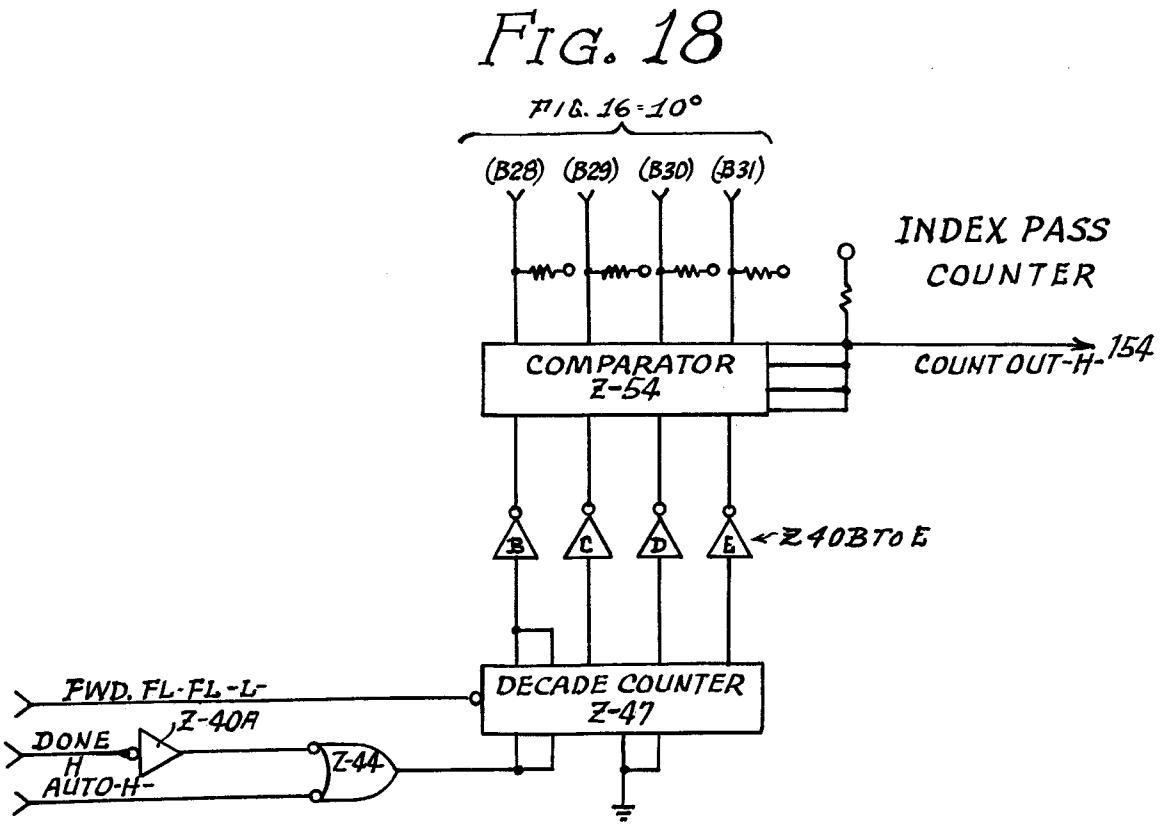
Figure 19:
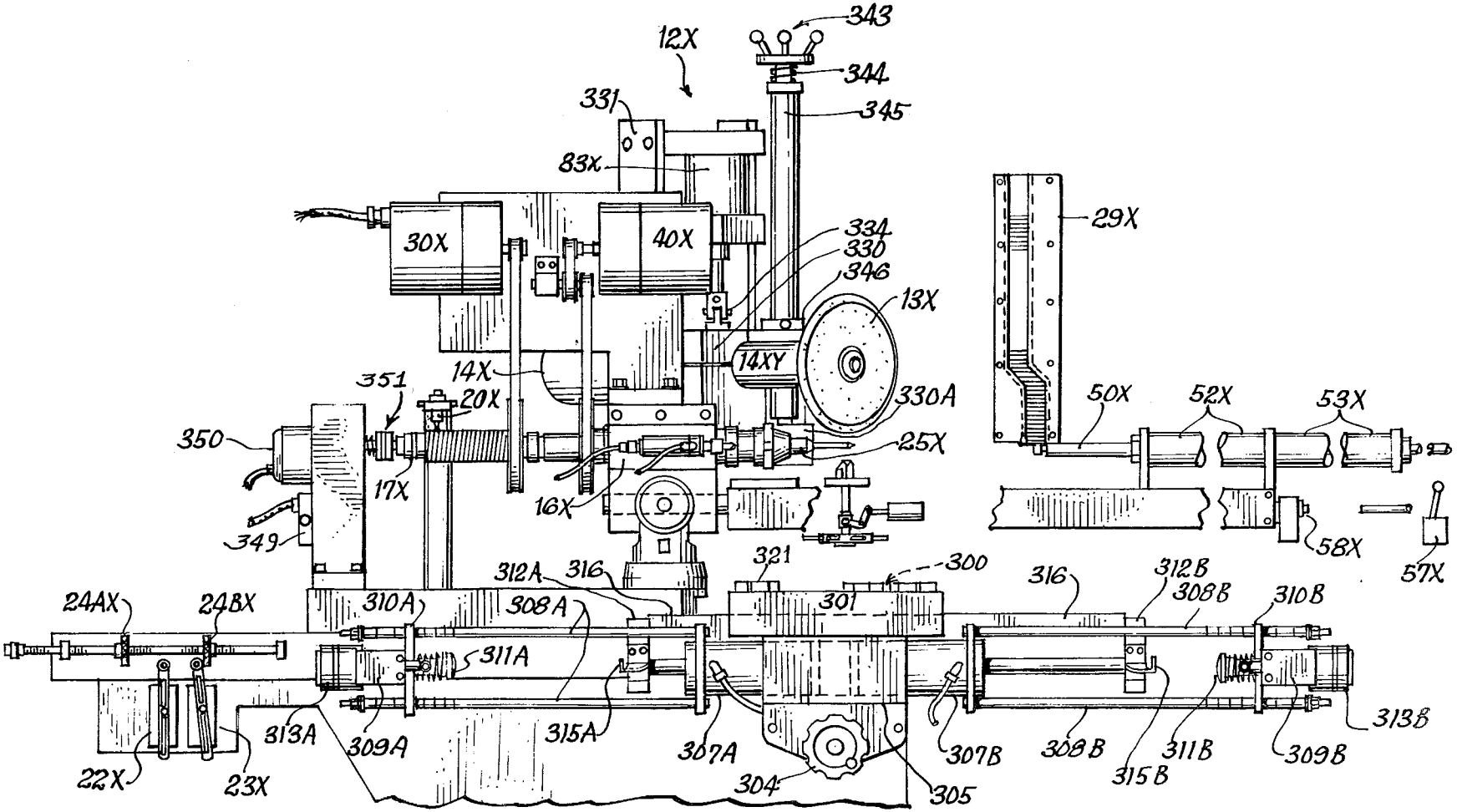
Figures 20, 21:
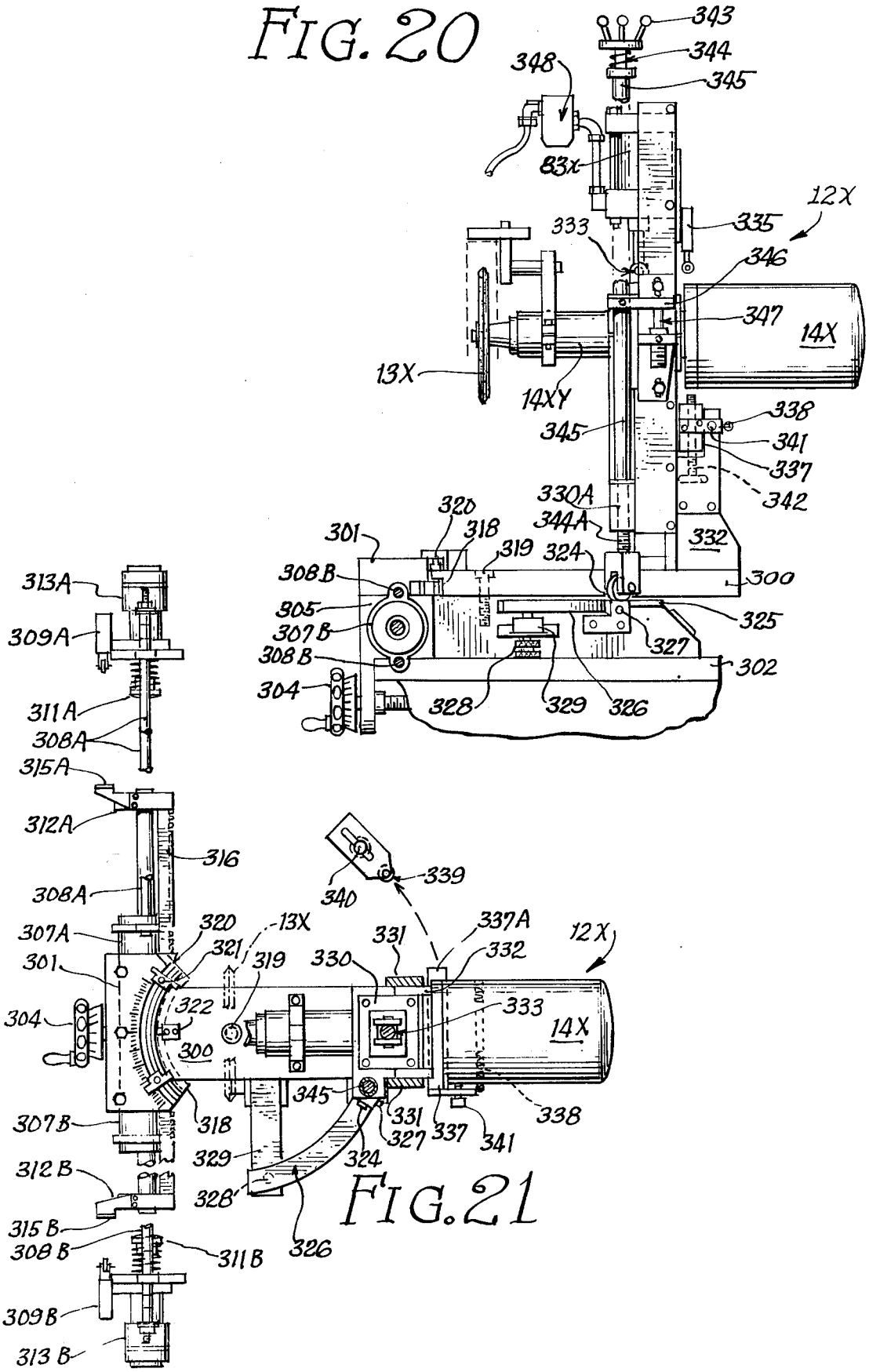
Figure 22:
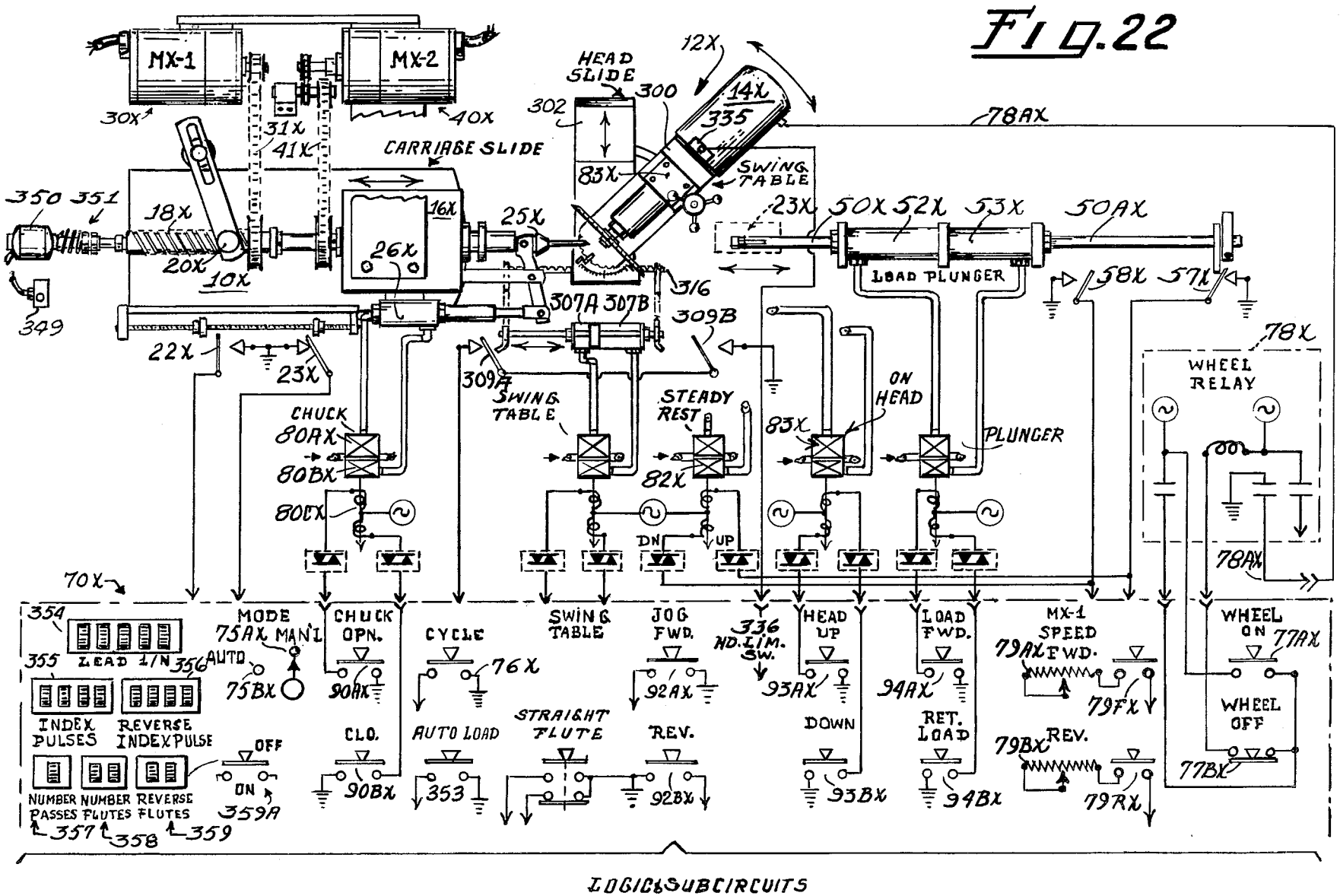
Figure 23:
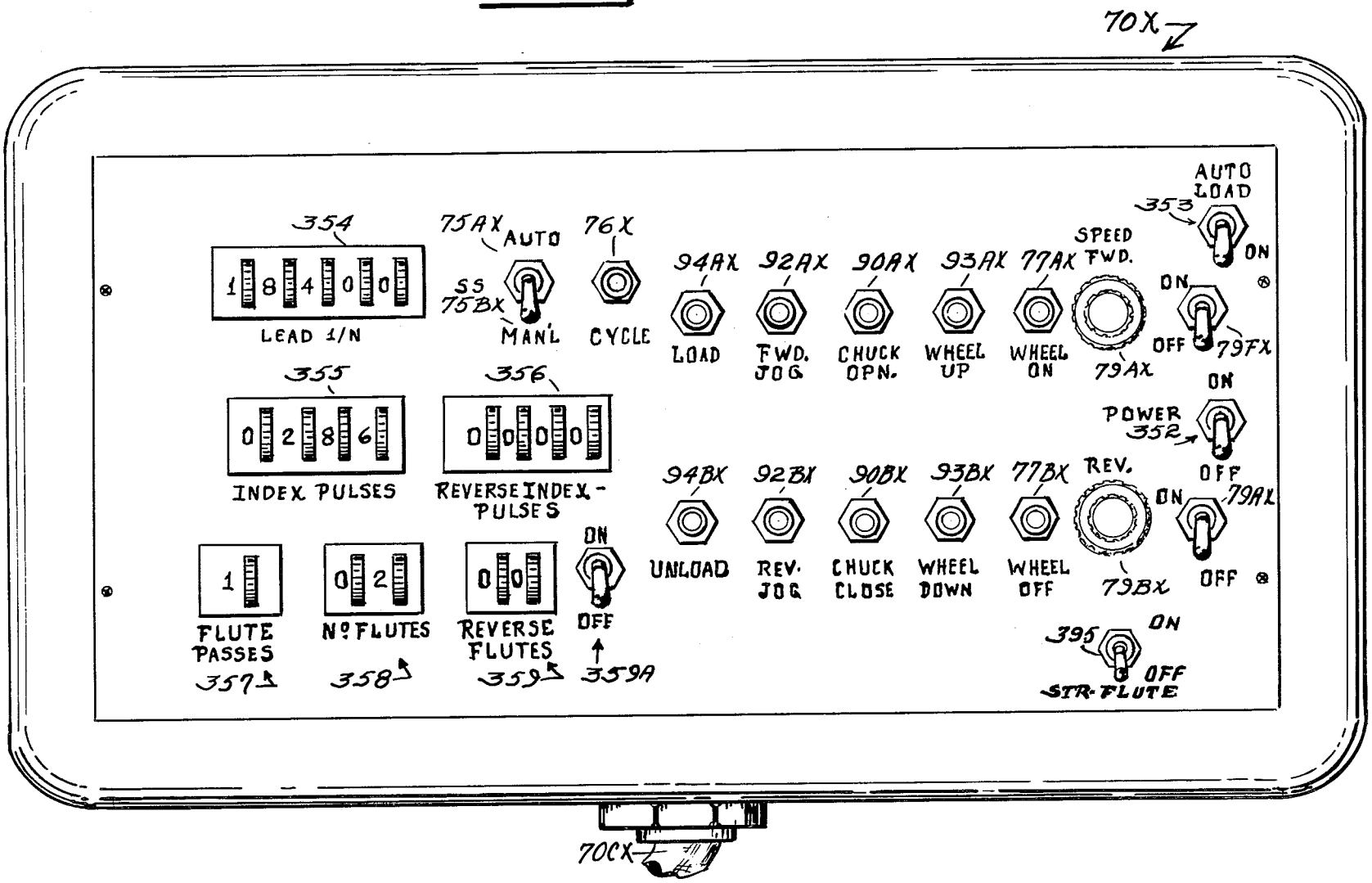
Figure 24:
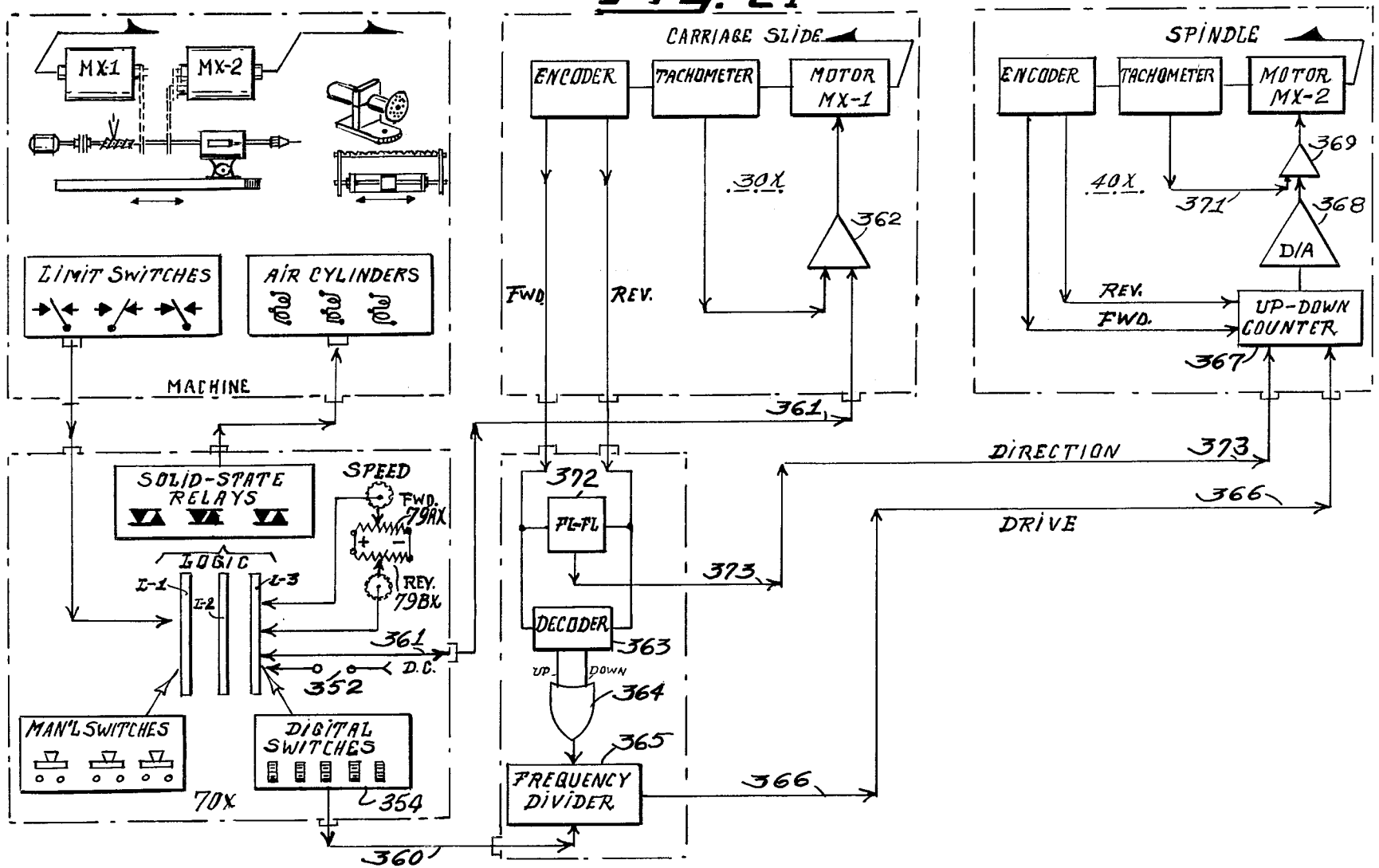
Figure 25:
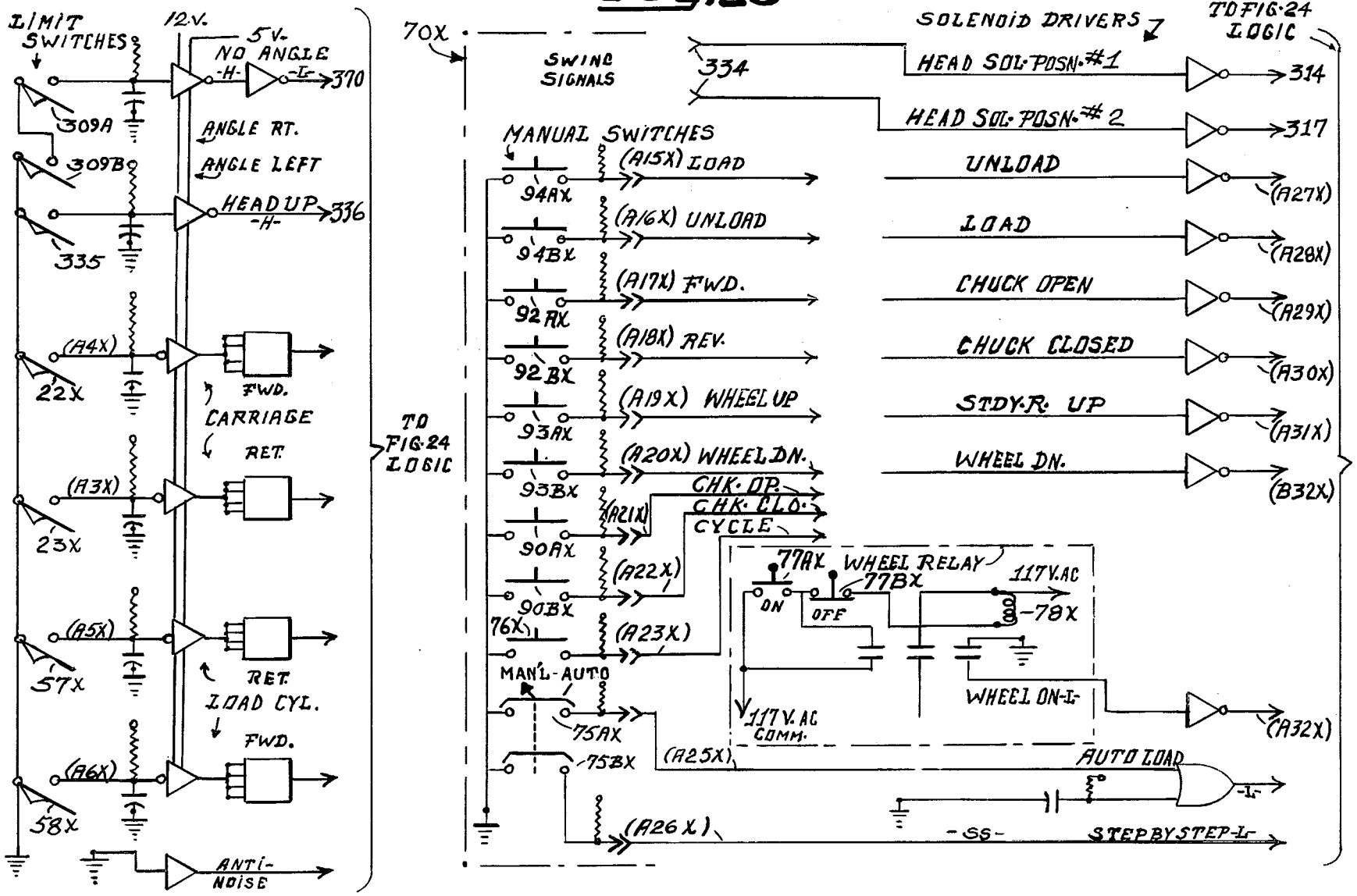
Figure 26A:
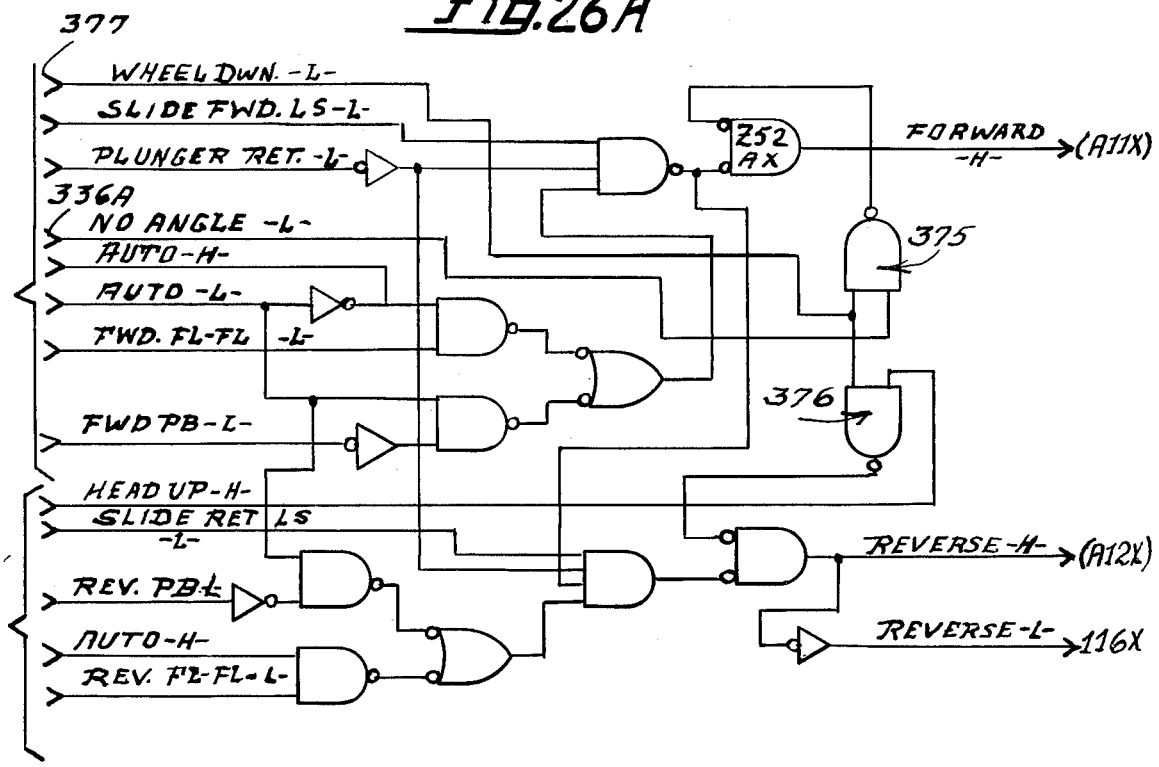
Figure 26B:
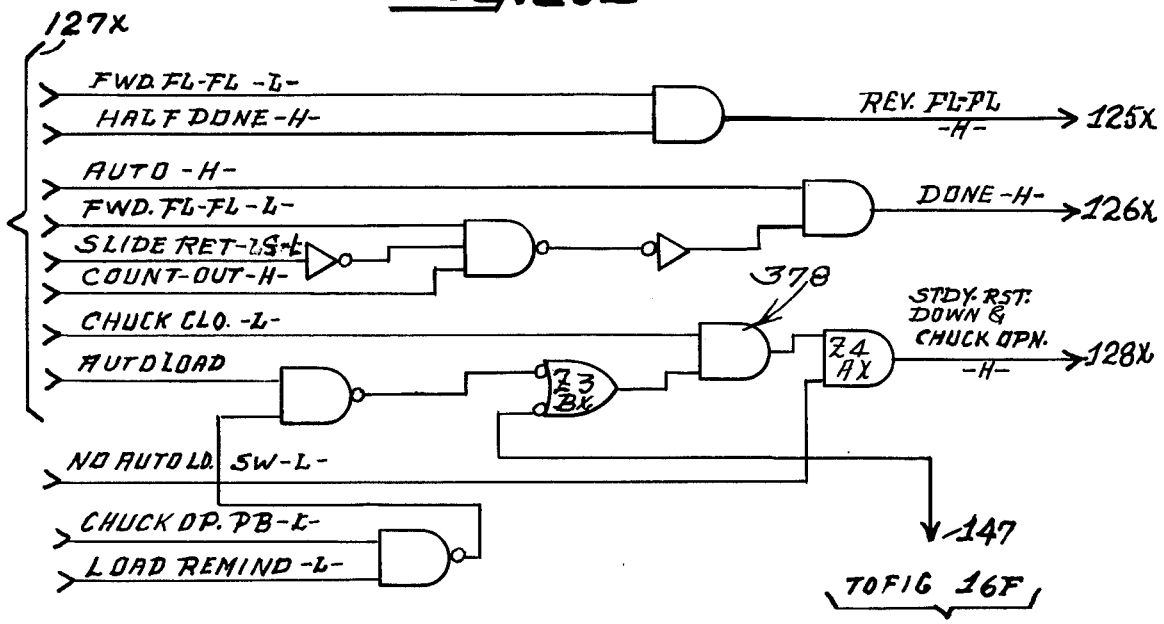
Figure 26C:
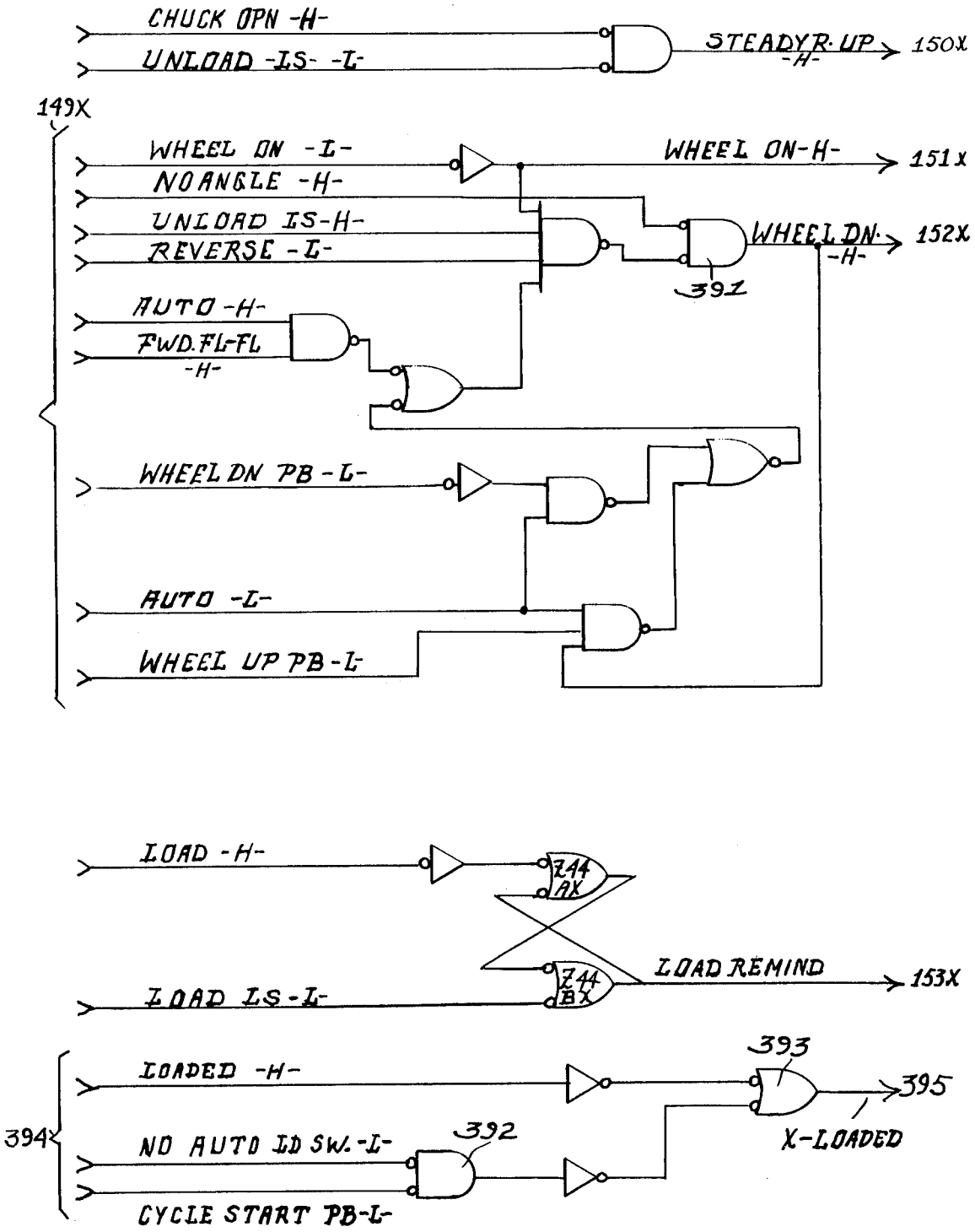
Figure 27:
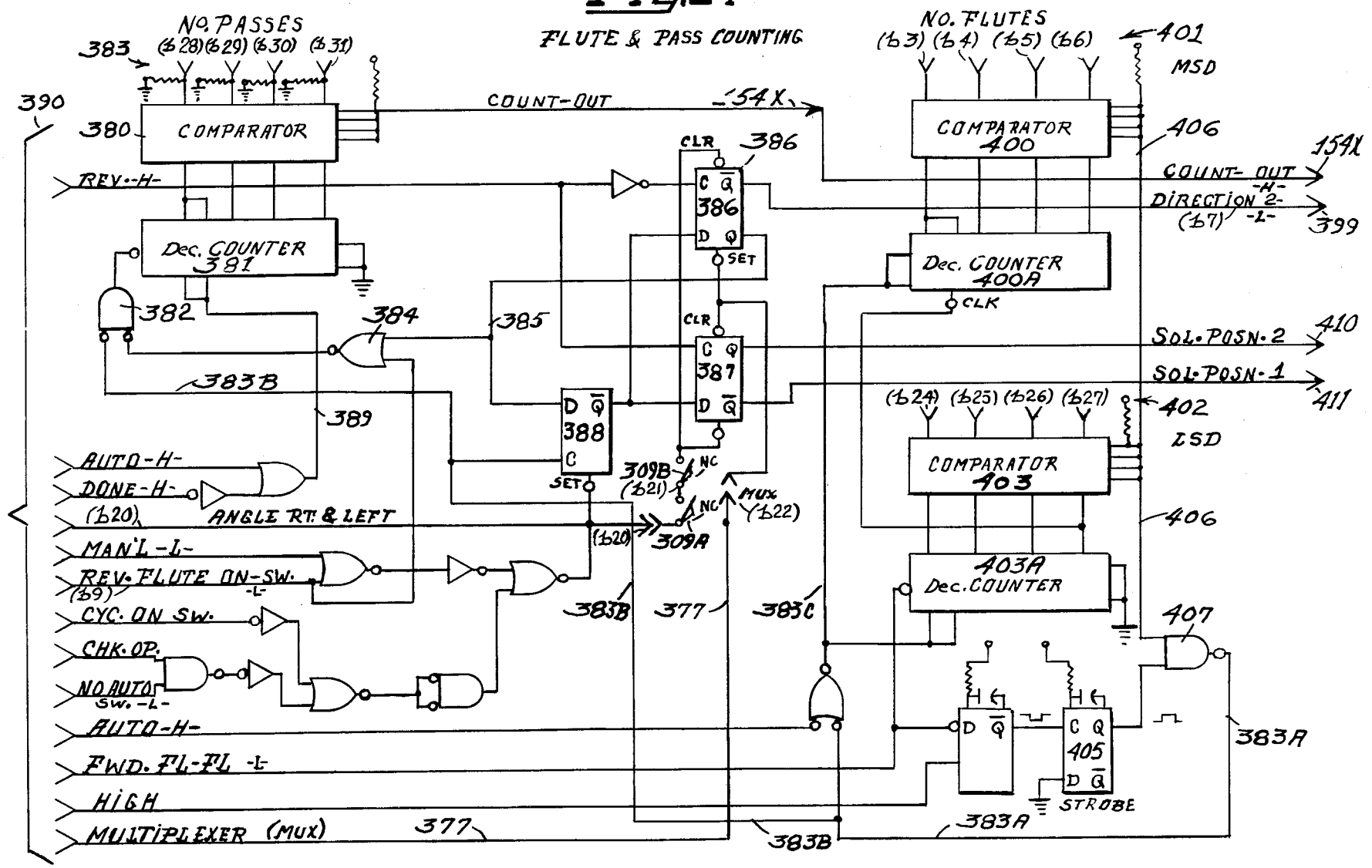
Figure 28A:
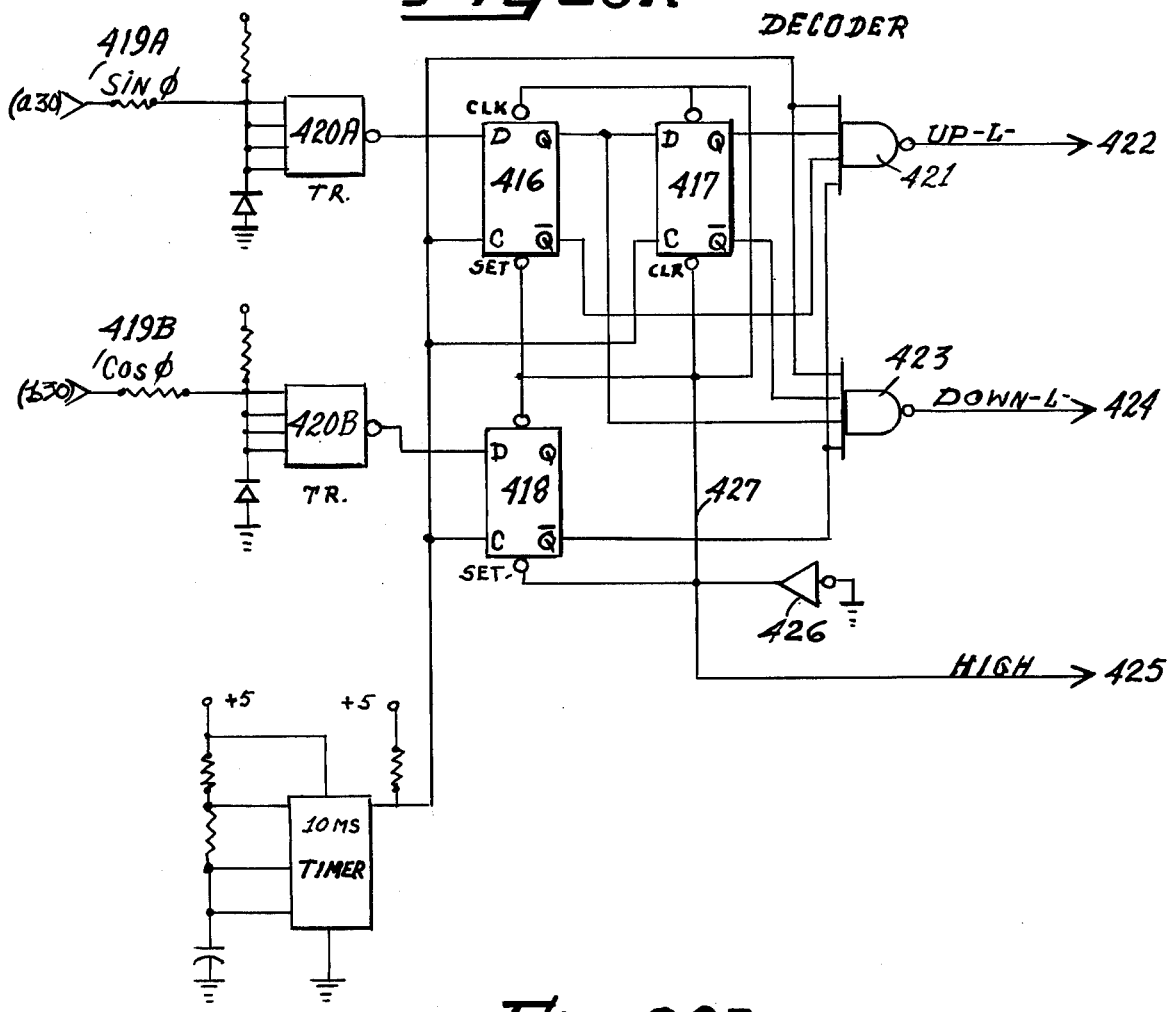
Figure 28B:
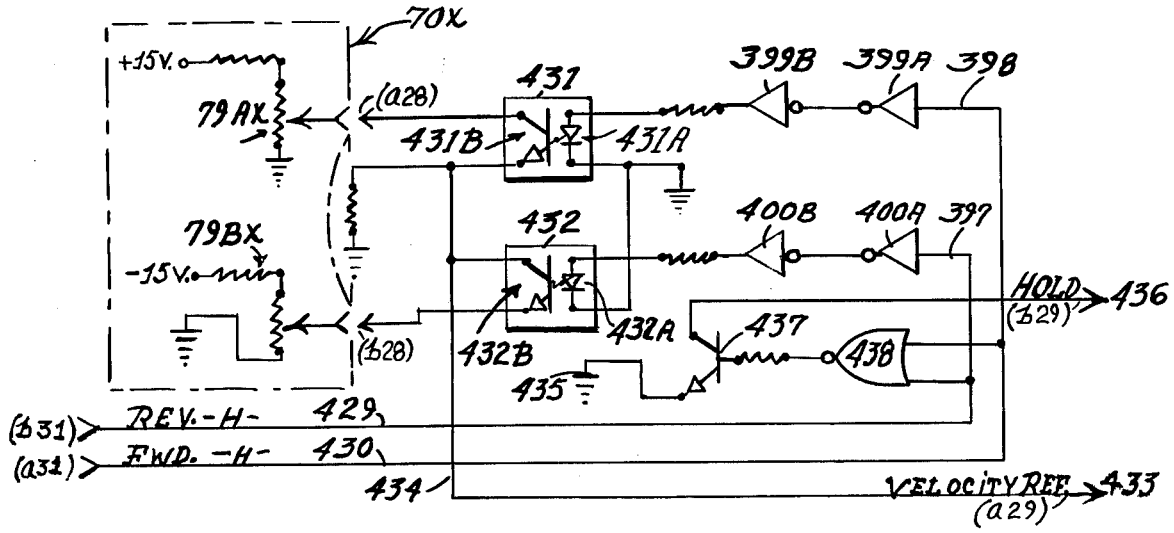
Figure 29:
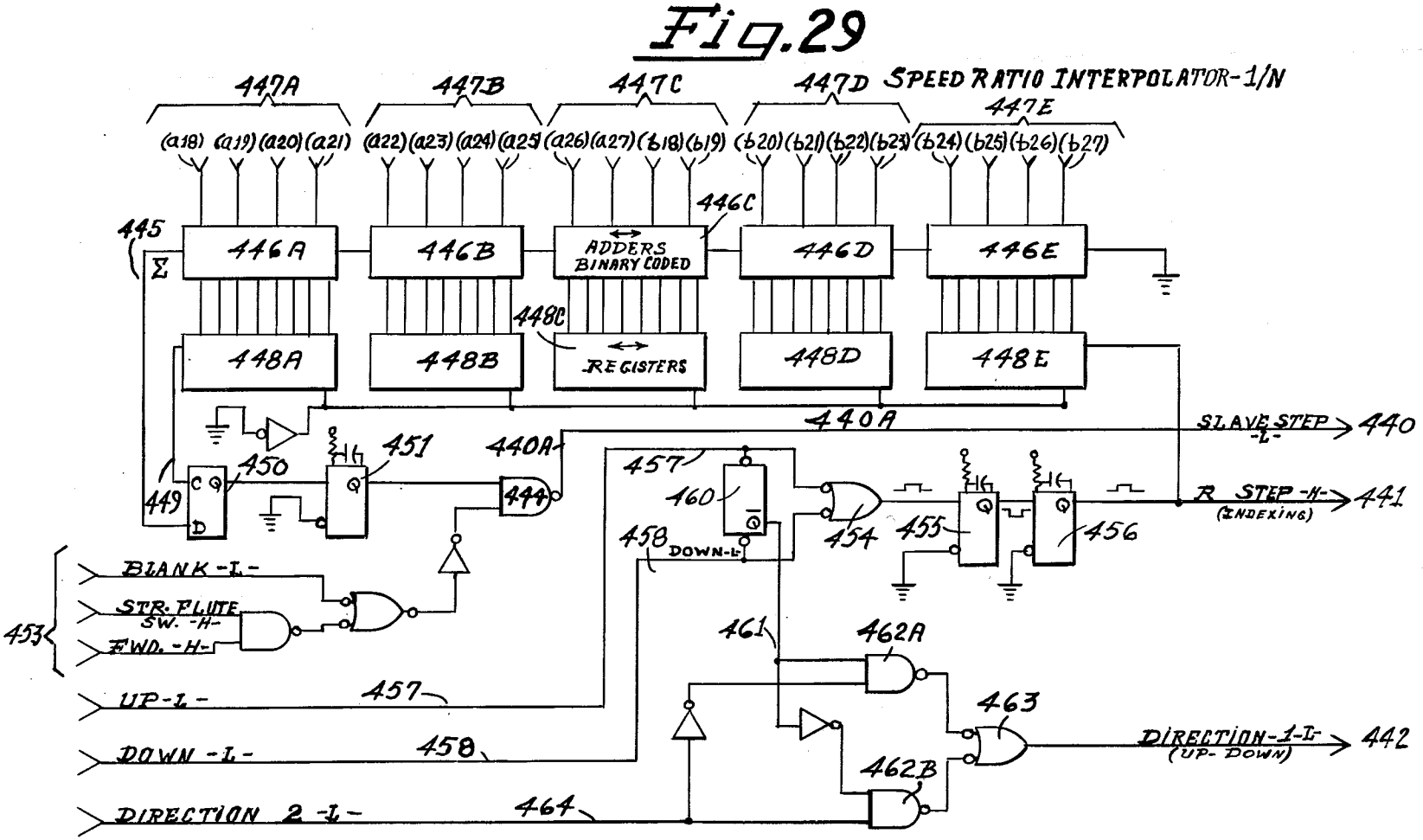
Figure 30:
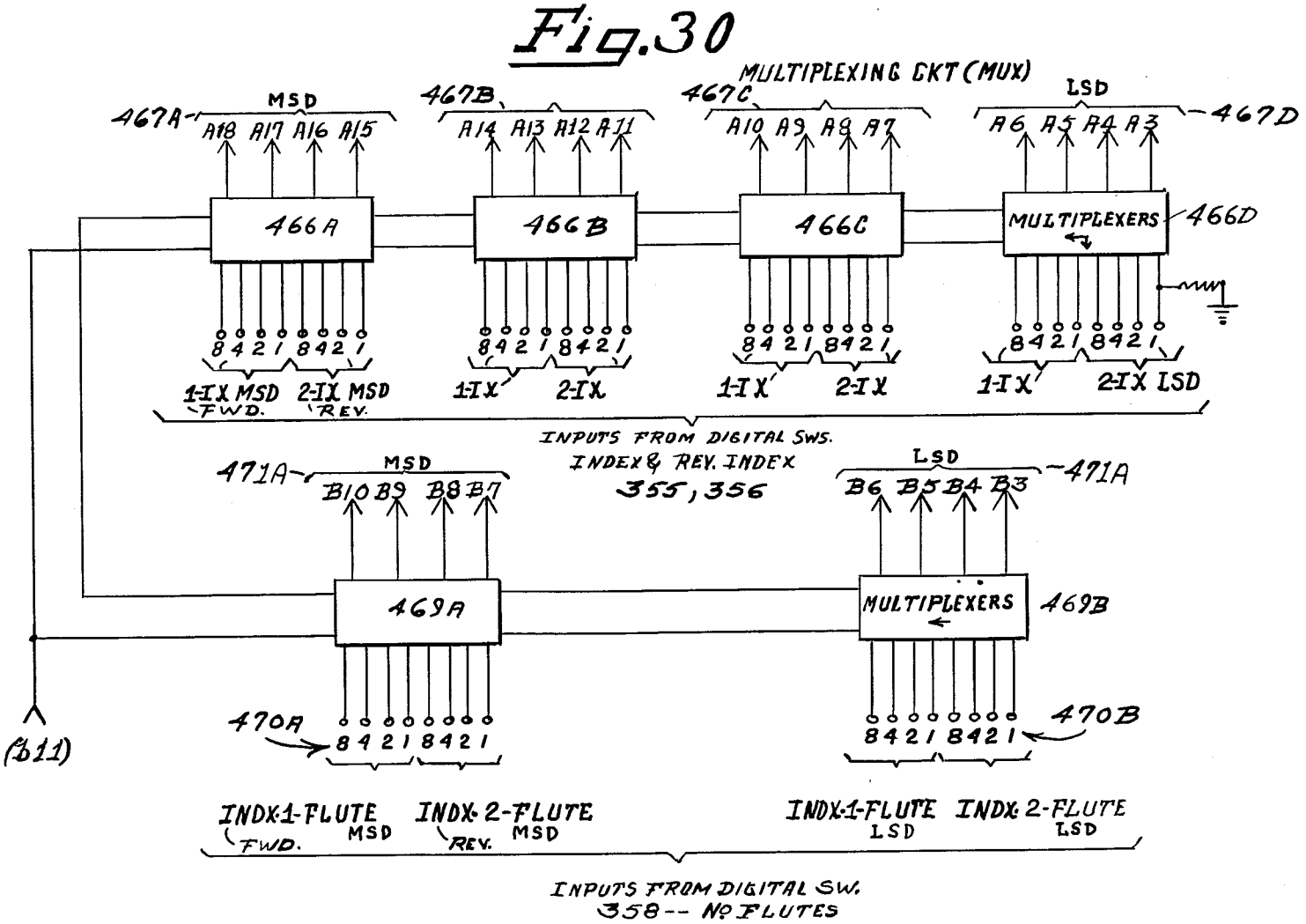
Figure 31:
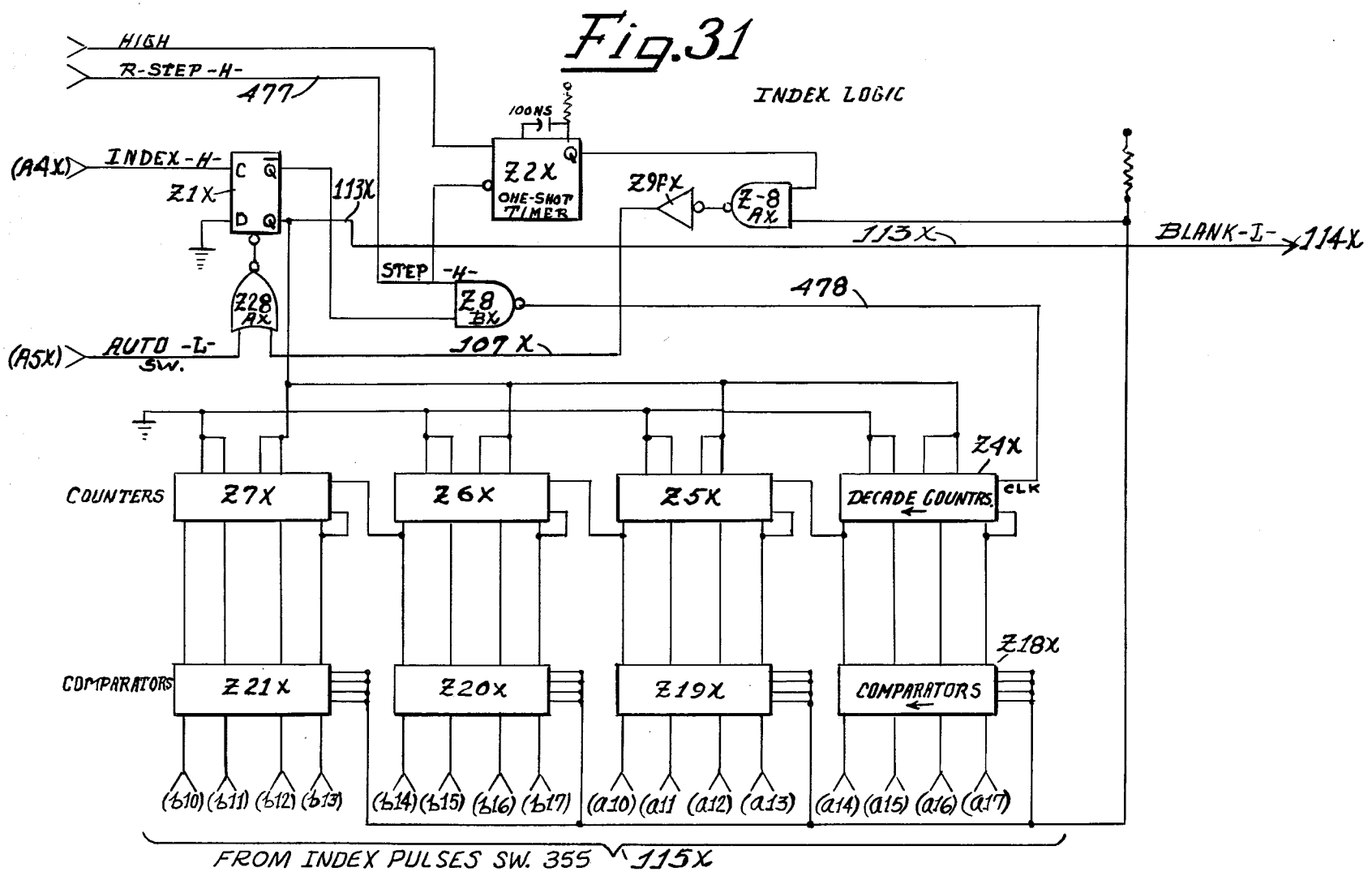

FIGS. 6 and 6-A are respectively a side view and a sectional view of a finished drill body illustrative of one form of fluting effected by the machine in a single automatic duty cycle;

FIG. 7 is a front elevational view of the control unit for the machine of FIGS. 1 and 2;

FIG. 8 is a block diagram of the motor drive and control system for the machine of FIGS. 1 and 2;

FIG. 9 is a circuit diagram relating to the manually-operable switch means and connections into the solid-state duty-cycle programming logic and control system for the machine of FIGS. 1 and 2;

FIG. 10 is a circuit diagram relating to the pulse generating circuitry for driving the spindle and carriage motors of FIGS. 1 and 2;

FIGS. 11 and 12 depict respective frequency dividing subcircuits for the carriage and spindle motors M-1, M-2;

FIG. 13 depicts details of index logic circuitry;

FIGS. 14 and 15 respectively depict related master and slave pulse translating subcircuits for the carriage and spindle motors M-1, M-2;

FIGS. 16-A through 16-F depict logic subcircuits for controlling manual and duty-cycle functions of the embodiment of machine in FIGS. 1 and 2;

FIGS. 17-A through 17-C depict further control logic subcircuits;

FIG. 18 depicts a pass-counting subcircuit cooperative with the indexing logic for the machine of FIGS. 1 and 2;

FIGS. 19 through 31 relate to a modified swinging head embodiment of the machine with FIG. 19 depicting a front elevation of the same;

FIGS. 20 and 21 respectively depict a side elevation and a partial top plan view of the swing head structure;

FIG. 22 is a plan layout of the modified machine components and circuit elements similar to FIG. 2;

FIG. 23 is a view of the modified control unit and switch panel;

FIG. 24 is a block diagram for the modified machine and similar to FIG. 7;

FIG. 25 is a modified switch diagram similar to that of FIG. 9;

FIGS. 26A, 26B, 26C depict modified logic subcircuits;

FIG. 27 is a digital to binary subcircuit used in counting the number of passes and flutes in the modified machine;

FIG. 28A depicts the decoder subcircuit for the modified motor control circuitry;

FIG. 28B depicts a velocity reference speed control subcircuit for the modified motor drive;

FIG. 29 is an interpolation subcircuit utilized in setting the helix angle or speed ratio for the modified motor drive;

FIG. 30 depicts a multiplexing subcircuit employed in governing cutting of multiple reverse flutes in the modified machine;

FIG. 31 depicts an Index Logic subcircuit for the modified machine, substantially like that of FIG. 13.

As depicted in FIGS. 1 and 2, the flute-grinding machine includes a number of basic components found in machine tools of the class described, such as a work spindle 17 supported on a carriage slide or table 10 shiftable linearly in the direction of the spindle axis on base structure 11 to travel the spindle and its work-holding chuck 25 relative to some form of tool or grinding facility, such as the abrasive wheel 13.

In the present machine the work spindle 17 is equipped with a known form of automatic chuck 25, and is journalled in a spindle head 16 adjustably seated on the carriage slide 10, the chuck 25 being opened and closed by air cylinder means 26 and associated lever-actuating means 27 carried on the side of the spindle head. The rearward end of the spindle remote from the chuck is fitted with lead-screw means which will preferably be an improved form of tracking sleeve comprising a sleeve member 18 provided with a helical tracking groove 19 into which projects the end of a stationary tracking stylus 20 supported on a fixed post means 21 on the machine base and effective responsive to rotation of the sleeve, which floats independently about the spindle, to impart a linear thrust to the carriage slide for movement thereof between advanced and home positions, according to the direction of rotation of the sleeve, and at a rate of travel which will depend upon the speed of rotation of said sleeve and the lead or pitch of its tracking groove, all in a manner such that the concurrent linear motion of slide and rotary motion of the spindle produce a resultant compound motion with spiral displacement of the work relative to the grinding wheel or other tool when the speed ratios of the driving motors are set at appropriate speed ratios.

In accordance with the invention, the movements of the carriage and spindle are effected by separate pulse-controlled motors 30, 40 carried on a mounting plate 15 footed on the spindle head 16, motor 30 being coupled to the lead-screw means or tracking sleeve 18 by gear belt 31 trained over a gear 32 fast on the sleeve, while motor 40 is similarly coupled by gear belt 41 working in a gear 42 which is fast with the spindle, said motors being supplied with driving pulses generated by circuit means described hereafter.

The tool head 12 with its cutting wheel 13 and driving motor 14 is adapted to rise and descend as a unit in known manner under control of a corresponding air cylinder mens, indicated at 83 in FIG. 2, to shift the grinding wheel to and from cutting engagement with the work carried in the spindle chuck. A steady-rest structure equipped with novel tool rest means 60 is actuated by its corresponding air-cylinder means 67 to rise or descend from work-supporting level beneath the chucked work piece in timed relation with the movements of the tool head and action of other machine components including the carriage slide 10, chuck 25, and a loading plunger 50, in duty cycles which will effect the loading of a drill blank automatically into the chuck, formation successively of multiple flutes thereon, and discharge of the finished drill body from the chuck at the conclusion of the cycle, with the carriage, chuck, and loading means standing in certain normal starting conditions in readiness for succeeding cycles.

The novel tool-supporting means 60 for forming part of the steady rest structure, as detailed in FIGS. 4, 5, and 5-A, is especially adapted to provide precision support for the drill bodies, and takes the form of a head block 60 carried at the upper end of a vertically-shiftable steady rest post 60A, said block having a square cross-section with two adjoining sides seating slideably into the trough of a V-shaped groove in a slideway block 61 into which the head block is seated by the thrust of roller means 62 carried on a pivot bracket 63 pivotally joined at 63A to a dog-leg lever 64 which is urged by adjustable spring means 65 to press the roller against the block 60 on the side opposite from the slideway.

One end of the dog-leg lever is pivotally connected as at 64A to the vertically shiftable steady-rest post 60A, while the opposite end thereof connects pivotally with the plunger of an air cylinder 67 operative reversely to raise or lower the post 60A and elevate or retract the block 60 from supporting position beneath the drill bodies or other work piece.

As depicted in FIGS. 5 and 5-A, the top of the block 60 is faced to provide a small land in which is formed a gib track 69 of short horizontal extent and having a dovetail cross section and separated by a slit down the middle, as at 69A, so that one-half of the gib track shifts laterally of the other half to permit substitution of drill-seating blocks by varying the width of the gib track groove responsive to turning of a set screw 69B. The gib has a V-shaped drill-seating groove 69C conformably with the diameter of the drill bodies to be supported. The function of this tool rest is such that when the post and block means 60, 60A rises beneath the chucked drill piece, the V-shaped seating groove will interfit with the cylindrical drill body and contact the same at two points as indicated in dotted lines in FIG. 5-A, while leaving a short end portion of the drill projecting into space in exposure to contact by the grinding wheel. The post 60A is provided with adjusting screw means 68 (FIG. 4) operative to set the upper limiting level of the tool rest when rising to supporting position.

With reference to FIGS. 1 and 2, blank drill bodies 28 are stacked in a gravity-feed magazine 29 having a bottom exit overlying a seating slot 51 formed in the end of a loading plunger 50 such that when the plunger starts at home position beneath the magazine (FIGS. 2 and 4) it will pick up one blank in said seat and transport it into the open chuck at a time when the tool head and steady rest are withdrawn to non-obstructing positions, these latter actions, as will appear more fully hereafter, preferably being made to occur substantially simultaneously.

The loading plunger 50 is advanced and retracted by respective air cylinders 52 and 53, FIG. 2, to which compressed air will be admitted by operation of corresponding reverse-acting solenoid valve means 86A and 86B responsive to closure, in the manual operation, of "Load" and "Return" switch contacts 94A, 94B to energize the corresponding solenoid windings 86C, 86D, it being observed that the latter, and all of the other valve solenoids are maintained in their respective operative states by conventional solid-state relay means, such as 86E, 86F, utilizing Triacs, essentially identical air-cylinder and valve means being provided, as shown, to activate the other basic machine components in both the manual step-by-step mode and the automatic mode, including specifically the tool head 12, chuck 25, and steady-rest means 60, the circuit connections for the respective control solenoids, actuating switches, and supervisory switch means being brought to plug terminals (not shown) for cable interconnection with a control unit 70 including programme and control switches, logic, motor pulsing and translating circuitry, as described hereafter.

Supervisory limit switch means operative to signal the position of the carriage at its forward and home limiting positions respectively, comprises the carriage limit switches 22, 23, activated by adjustable trip nuts 24A, 24B, on the carriage; together with "Load Plunger" limit switches 57 and 58 activated by an adjustable trip rod 56 travelling with the plunger and actuating said switches in the advanced loading position when the drill blank is fully inserted into the open chuck, and the fully retracted condition of the plunger in readiness for the next loading advance.

STEP-BY-STEP OPERATION IN MANUAL MODE

For purposes of a generalized explanation of the operation of the machine in the manual, step-by-step mode, it may be assumed that some desired helix angle determined by the ratio of the rate of advance of the carriage slide 10 to the speed of rotation of spindle 17 has been set up on the thumbwheel or dial switch means on the control unit 70, FIG. 2, as by adjusting the "Table" switch 71 and the "Spindle" switch 72, whereby the appropriate stepping rates for the motors 30 and 40 will be determined, it being assumed further that the required "Index Distance" 2000 has been indicated on thumbwheel switch means 73 to determine the number of motor steps required for the desired amount of angular resetting or indexing displacement of the spindle to new starting positions for the appropriate number of flutes selected, the number of which will be indicated by the setting on the "Index No." switch 74 (2 flutes in this example), all such set up parameters being conveniently read from prepared tables showing the settings for various sizes of drills with various spiral leads.

At the beginning of a cycle the carriage 10 will normally stand returned to home position (toward the left, FIG. 2) and carriage limit switch contacts 23 will be closed, as will be also the plunger limit switch contacts 57 with the loading plunger 50 standing in home position (toward the right); also the tool head 12 and steady rest 60 will be withdrawn from their respective operative positions and the chuck 25 will stand open. A blank drill body will be lodged in the open chuck by operation of the "Load" switch to close its contacts 94A, thereby energizing the appropriate solenoid winding 86C to admit air to the "Load" plunger cylinder 53 causing plunger 50 to advance the drill blank seat 51 into the open chuck.

Operation of the "Chuck" switch to close contacts 90B will energize the appropriate solenoid valve winding 86C to cause air cylinder means 26, 27, to close the chuck, whereupon operation of the plunger "Return" manual switch closing contacts 94B will cause the loading plunger to be retracted to "home" position by action of air cylinder 52.

The tool rest will rise to work-supporting position responsive to operation of the loading limit switch 57 when the load plunger returns to home position, the contacts of this switch being preferably connected in parallel with steady-rest conductor 91 so that the steady-rest must start down as the load plunger starts forward and vice versa and the rest cannot start up before the plunger has started back to its retracted or "unload" position. Thus when switch 57 operates the steady-rest rises into supporting engagement with the work and the tool head descends to working level to engage the cutting wheel with the supporting workpiece. In the manual mode, movements of the carriage must be effected by the Jog Switches 92A, 92B, and there is no automatic indexing of the work.

AUTOMATIC MODE

CONTROL UNIT AND BLOCK DIAGRAM

The manual override switches mentioned in view of FIG. 2 and more particularly detailed in FIG. 9, are intended primarily for job set-up and checking purposes and are conveniently arranged on the panel of a compact and essentially portable control unit 70, such as depicted in FIG. 7, along with the digital thumbwheel switches 71–74 which control the pulse-drive means for the carriage and spindle motors M-1, M-2, and automatic indexing drive means and control circuitry, all of which is further illustrated schematically in the block diagram of FIG. 8 wherein programming logic subcircuitry is represented by logic cards L-1 and L-2 having inputs extended thereto via cable means 70C from the carriage limit switches 22, 23, and the loading plunger limit switches 57, 58, with output control signals via Solid State Realys 86E...86F returned to the machine to activate the respective Air Cylinder Solenoids and appertaining valves which in turn actuate the Air Cylinders according to the programmed duty-cycle sequence.

The general programming or duty-cycle logic is detailed in FIGS. 16A through 18, while other logic circuitry pertaining to pulsed drive of the motors, as such, and setting of the speed ratios and indexing operations is included on appertaining frequency dividing and translating cards in unit 70 to enable setting of the "Index Distance" (angular displacement of the spindle for successive flute-starting positions) and the "Index Number" (number of flutes required to be cut in the same duty cycle) which depend upon activation of the motors by binary pulses under control of the aforesaid digital switch means, as will further appear in view of the more detailed description of the motor pulsing subcircuitry shown in FIGS. 8 and 10 through 15.

Carriage and spindle motors M-1, M-2, suitable for actuation by binary pulses may take the form of stepping motors 30 and 40 having windings as indicated in FIG. 8, which are successively energized to advance their respective drive shafts responsive to binary pulses applied repetitiously in the sequence indicated in FIG. 8 at the respective motor terminals designated A, C, B, D and $\overline{A}$, $\overline{C}$, $\overline{B}$, $\overline{D}$, as outputs from corresponding Master and Slave Translating Circuits TC-1, 2, 3, 4, detailed aspects of which are further described hereinafter in view of FIGS. 14 and 15.

INDEXING METHOD

The spindle is indexed to successively new starting position, as in cutting multiple flutes each equidistantly separated from the others, during lost-time return travel of the carriage by the method of rendering the spindle pulses temporarily ineffectual beginning at the instant a given flute or other cutting operation is finished and counting both carriage and spindle pulses until a signal is produced as the result of a comparator circuit match between the "Index Distance" value set on digital thumbwheel switch 71 and an equivalent count of blanked drive pulses as a parameter which equates to the distance the carriage must travel after the spindle is restarted in rotation so that the workpiece will meet the grinding wheel at the precisely correct starting or index position for the next flute or other cut.

Reference tables are prepared giving the "Index Distance" in terms of digital pulse values for different types of work, along with the relative pulse values for determining the carriage and spindle speed ratios which correspond to a wide range of helix or spiral lead angles so that the machine operator can quickly enter the necessary settings for any type of work into the digital switches 71 to 74.

The described indexing methods represent a substantial savings in lost time by which the production rate of the machine can be greatly increased over other types of machine in many of which the carriage or spindle or both must be stopped while the indexing adjustments are made. By setting the reverse drive speed for the carriage at potentiometer 79B the return travel of the carriage is speeded up so that the production rate for the machine can be increased by as much as thirty percent over other types employing conventional indexing methods.

AUTOMATIC MODE LOGIC CIRCUITRY

In accordance with FIGS. 2, 8 and 9, the several machine activating components, such as the air cylinders and solenoids, and the respective limit and manual control switches, have terminal connections extending into the control unit 70 via cable mens 70C, wherein the limit switches connect with terminals (A3) (A4) (A5) and (A6), FIG. 9, and respectively act through corresponding noise rejection means comprising inverters Z-1 and Schmitt triggers Z-2, such signals being then directed into the logic circuitry according to FIGS. 16 to 18, as will further appear.

The respective pushbutton switches 76 and 90A, -B...94A, -B, involved in cycling the machine and variously actuating the solenoid valve means, stand normally open and when closed will apply ground, as at terminals (A15) to (A24), to sink the indicated normal +5 volt stabilizing pull-up bias maintained on the corresponding inverters Z50A to Z50F and Z43, respectively connecting to terminals (A27) through (A32) and (B32), FIG. 9, for extension via cable 70C into the logic cards L-1, L-2, whereby to produce requisite output signals responsive to actuation of the appertaining manual switches at the binary "HIGH" and "LOW" values as indicated.

Mode switch contacts 75A connecting with terminal (A25) are normally open and will inhibit automatic operation due to the state of gate Z38 and enable single step operation as the result of the condition on output (SS) due to open contacts 75B, and vice versa, to enable automatic operation due to the signal on "Auto." output (14) when the switch is changed to the automatic mode.

Power to the grinding wheel motor 14 is provided by closure of the "Wheel On" switch contacts 77A to energize the winding 78 of relay Z36 at terminal (A9) via normally closed manual "OFF" contacts in series with the "ON" contacts (when closed), and power at terminal (A9) of the relay will establish its own holding circuit at relay contacts 78A via terminal (A10), such holding circuit being broken to drop the relay and stop the wheel motor responsive to actuation of the manual "OFF" switch and resultant opening of its contacts 77B. Voltage present on the relay winding in the aforesaid holding condition will apply a "Wheel On" signal to the logic system via another inverter Z-1E.

MOTOR PULSE GENERATING MEANS

Driving pulses for the two motors, M-1, M-2, are produced by a master pulse-generating means in combination with frequency dividing means and translating means, wherein two pulse generators or oscillators of identical character are used for forward drive and reverse drive in order to achieve stability and accuracy with minimal adjustment problems. As shown in FIG. 10, the two generators or oscillators Z 22 and Z 23 and associated circuitry are substantially identical, so that only the forward driving embodiment will be described.

A forward command signal at input (4) will be applied to oscillator Z 22 via inverter Z 9A, a combination ramping and constant-current subcircuit comprising another inverter Z 9B, unijunction transistor Q 2 and a control capacitor of about 5 mfd., and a voltage-dropping means including diodes Da, Db and transistor Q1, with resultant triggering of an oscillator output which is passed through a wave-shaping and degliching subcircuit comprising unijunction transistor Q 3 and a Schmitt trigger Z 15 to provide a clean square-wave output pulse on conductor 109, via gates Z-16A, -B, and -C. Gate Z 10A makes available a source of counting pulses on output conductor (10) for utilization in other subcircuits.

The basic pulsing rate can range from 3000 to 300,000 pulses per second and can be modified for speed and ratio purpose in three ways: by adjustment of the "Forward Speed" potentiometer 79A (or "Reverse" potentiometer 79B) on the control panel, which is connected to the appertaining pulse oscillator at terminals 5 and 6 thereof (or terminals 15 and 16 for the "Reverse" oscillator), adjustment of which will afford an approximately 10:1 speed adjustment range; or alternatively by actuating either digital ratio control 71, 72, FIG. 7, to a setting of 10 through 99 at the control panel to disable a "Divide-By-Ten" Counter means Z 2E providing a higher pulse rate at the (D 10) output via gate Z 10B, the normal output "Dividie-By-Ten" being gated at Z 16B to appear on output (D 1).

Both pulse generators provide a "Low" speed which will be available as the result of operation of potentiometers 79A, 79B, connecting to terminal 7 at the oscillator and having the effect of shorting or grounding out capacitor 110 to produce a lower driving pulse rate, it being observed that the reverse-driving generator circuit affords the same drive at terminal (A 17) under control of panel switch 79R.

The aforesaid ramping subcircuits provide an accelerating influence on the motors in order to overcome their inherent inertia when starting or reversing.

Arbitration logic controls the second of the tree speed control methods and is provided by the arrangement shown at the lower left of FIG. 10 for the purpose of reducing somewhat adjustments by the machine operator in changing the helix angles or table to spindle ratios in cases where there is a large change in the indicated ratios at the switches 71 and 72.

Input 11 connects with the tens digit terminal of the "Frequency Dividing" circuit (to be described) for the spindle rate, while terminal 12 connects with the like terminal of the "Frequency Dividing Means" for the carriage slide and the signals from both are applied to a four-input gate Z 10D, the output of which connects with the "Divide-By-Ten" input of Gate Z 10B and also to inputs on gate Z 10E with the output of the latter connecting to the "Divide-By-One" input of Gate Z 16C.

The purpose of the foregoing arbitration logic subcircuitry is to detect large changes in the ratio digits, and the effect is to make a 10:1 adjustment in speed in such cases to save set-up and checking time of the operator.

For example, in order to flute a No. 75 drill body at a helix angle of 28°, the dial switches 71, 72 will be set at 25/50, signifying that for every 25 steps of angular movement of the spindle the table must advance by 50 steps in order to yield the required lead of 0.125 inches per revolution at the angle specified. However, if the next job requires a setting of 74/25 for the same angle, as would be the case of a ⅛-inch drill with a lead of 0.740 inch, the speed change for the new ratio is considerable, but the set-up is simplified for the operator nevertheless because the automatic adjustment of the speed by a factor of 10 scales the relative magnitude of the manual adjustment down from 74 to 7.4.

FREQUENCY DIVIDING AND INDEXING CIRCUIT MEANS

The frequency-dividing circuitry includes three subcircuit arrangements comprising, respectively, a first divider for the carriage slide or table motion component, as illustrated in FIG. 11, and a second divider for the spindle rotary motion depicted in FIG. 12, together with a subcircuit for indexing, as set out in FIG. 18.

The said frequency divider circuits are essentially alike with the principal difference that the circuit of FIG. 11 includes a timing means Z 38B supplying a "WAIT" or delay signal, utilized in other subcircuits, and triggered by a blanking signal derived from the indexing circuit of FIG. 18.

Accordingly, and with these differences understood, only the divider circuitry for the carriage motion will be described in detail.

Referring to FIG. 11, the ratio or motor-stepping speeds are controlled primarily by thumbwheel switches 71 and 72, FIGS. 2, 7, 8, which are conventional digital binary-coded decimal switches respectively operable to set the values of the numerator and denominator of the carriage-to-spindle speed ratios in a range from decimal 01:01 to 99:99, and provide digital input signals to the frequency divider circuitry weighted accordingly, the TENS values being applied to terminals B-23, -24, -25, -26, and the UNITS values being applied to terminals B-27, -28, -29, -30.

The pulses from the master oscillator or pulse-generating means appearing at output 10 in FIG. 10 are applied to input terminal A 3 in FIG. 11 to trigger a first sample-pulse timer Z 45A, which may be a resettable monostable dual timer type 74123 provided with a 100 NS delay circuit connected to trigger a second such timer Z 38A via gate means Z 8A incorporating a 10 MS delay and providing a first output at Q 12 extended via conductor 111 for a pair of tens and units counting synchronous clocks Z 46, Z 53 (e.g. 74160) as a clearing signal, and a second drive pulse output at terminal A 5 which is gated by gates Z 34A and Z 34B and respective inverters Z 17A and Z 17B to apply forward and reverse carriage slide or table drive signals on corresponding terminal B-8 and B-9, control signals for gating these pulses being applied to forward input and reverse input terminals B 20 and B 30, respectively, passed by gate Z 34A and inverter Z 17A to terminal B 9, as the forward slide travel source responsive to the forward gating signal for forward slide travel applied to gate Z 34A at terminal B 20. Driving pulses from Q 5 are also passed by another gate Z 34B and inverter Z 17B to terminal B 8 for use in the reverse slide drive, all such driving pulses, however, including those for the spindle in the corresponding pulse outputs of FIG. 11, being applied to the motor windings through the translating circuitry to be described hereafter.

In the aforesaid fequency dividing circuit, a blanking signal for indexing purposes is applied to the third timer Z 38B for trigering the "WAIT" or delay pulse to be provided at output 19.

The counter outputs are respectively passed via inverters, such as Z 34A, -B, -C, and -D, for the TENS counters, and Z 25A, -B, -C, -D to the inputs of the corresponding comparators (e.g. 8242 types) Z 54, Z 47, for which the corresponding reference inputs from the thumbwheel switches 71, 72, are connected to input terminals B 27, B 28, B 29 and B 30 for the UNITS values. Coincidence between the thumbwheel inputs, clock outputs, and sample pulse governs the frequency dividing function of the timers according to the setting of switches 71 and 72.

Monitoring of the carriage-to-spindle speed ratios by the arbitration circuit means of FIG. 10 is achieved in respect to the carriage slide or table component by Gate Z 31A FIG. 11) whose four inputs connect to the reference inputs to the TENS comparator Z 54 and look at the TENS input from the thumbwheel switch 71 to determine whether or not they equate to zero and adjust the motor pulsing speed accordingly, as explained in view of FIG. 10. The output of this monitoring gate connects from terminal B 4 to the carriage slide or table arbitration logic input 12 in FIG. 10.

Substantially the identical ratio monitoring means is employed for the spindle speed divider shown in FIG. 12 at Z 31B whose output at terminal B 5 connects with the arbitration logic input terminal 12 in FIG. 10, to control the pulsing rate for the spindle dependently upon the presence or absence or ratio change occasioned by changing the setting of thumbwheel switches, as described.

The frequency-dividing circuitry for the spindle speed component, as depicted in FIG. 12, is essentially the same as that described in view of FIG. 11 with respect to the connections and operations of the synchronous clocking means, comparators, thumbwheel switch inputs from the spindle switch 72, sample pulse timer Z 45B and timer means Z 52 for the spindle stepping rate. The dividing circuit omits a timer comparable to Z 38B in FIG. 11 for producing delay signals, and, instead, includes an additional gating means Z 55 activated by the blanking signal applied at input 112 to signal stoppage of the spindle motor for the duration of the required indexing count via gate Z 34D and inverter Z 24B to spindle pulse output terminal A 8, which together with the spindle forward output at terminal A 9 will be applied to the spindle motor through the translating circuitry hereafter described. The clock Z 32 and Z 39 and comparators Z 40 and Z 33 may be of the same types as described in the table or carriage slide frequency divider of FIG. 11.

INDEXING LOGIC AND COUNTER

Referring to FIG. 13, the indexing operation occurs only in the automatic mode as the result of an enabling signal from input A-5 to gate Z-28A to enable a flip flop Z-1 (e.g. Type 7474).

The Index signal from the carriage slide limit switch 23 appears on input terminal A-4 to trigger the flip flop and stop the spindle instantly, by producing a blanking signal from its output Q on conductor 113 and to enable the indexing counting means Z-4 to Z-7, as will appear more fully.

In order to assure a clean spike-free counting pulse, pulses from the master source designated "R-Step" at Gate Z-8B are used to trigger a one-shot timer Z 2F (Type 74123) to generate sample triggering pulses applied to the flip flop via inverter Z-9F and gate Z-8A and gate Z-28A, to provide rapid, glich-free counting. The blanking signal is available at output 114. The "R-Step" input enables the one-shot timer operation via gate Z-8B to sustain the pulsing of the flip flop and apply resetting signals to the decade counters Z-4 to Z-7, and to continue the blanking signals from Z-1.

The index counters are being continually set and reset to no effect in the absence of blanking pulses, but the index signal starts the flip flop blanking operation and thereby causes the counters to start the index count, which will continue until comparators Z-18, -19, -20, and -21 (e.g. Type 8242) match the count set up by the binary-coded outputs of "Index Distance" Thumbwheel Switch 73 which appear at the bracketed circuit board inputs 115 of the comparators designated in FIG. 13 as A-10 to A-17, and B-10 to B-17, the counting states of the decade units being applied to the comparator inputs in each instance through inverters such as Z-9, Z-12 and Z-13 to apply pull-up voltage.

When the pulse count matches the thumbwheel count at the comparators, a signal via conductor 107, via gate Z-8A to NOR gate Z-28A, will disable the flip flop and stop the index blanking so that spindle rotation can be resumed.

The number of times this indexing operation can occur depends upon the setting of the "Index Number" thumbwheel switch 74 and an associated index pass counting subcircuit comprising part of the logic circuitry to be described.

MOTOR PULSE TRANSLATING MEANS

The driving pulses provided by the basic frequency generating means must be applied to the multiple windings of the respective motors in requisite sequence and direction according to the pattern mentioned under FIG. 8, for which purposes translating circuitry of the type depicted in the companion master and slave subcircuits shown in FIGS. 14 and 15, is provided for the motors 30 and 40 to switch and steer the pulses and provide phase shift and amplification for the working levels to about 3 amperes per motor, and to assure that the motors do not get out of step.

FIG. 14 shows a master phasing generator and power amplifying means serving four of the eight windings of motor 30, while FIG. 15 depicts a companion phasing circuit operating as a slave to the master circuit but having its outputs displaced from those of the master circuit by 45° for energization of the remaining four windings of motor 30.

The translating circuits of FIGS. 14 and 15 are represented in FIG. 8 by the "Translating" circuit cards TC-1, TC-2, and it is to be understood that an identical set of circuit cards TC3, TC-4 will duplicate the master and slave translating circuits for the Spindle Motor 40, as shown, so that it is deemed unnecessary to repeat the description of the translating circuits for motor 40.

Forward or reverse driving pulses from terminals B9 or B8 of FIG. 11 applied to either of the corresponding input terminals 23 or 24 of FIG. 14 will gate clocking pulses via corresponding inverters 201 or 202 and gate 203 to JK type Flip Flop 204 having its respective outputs Q and $\overline{Q}$ connecting through respective gates 205, 206, to provide a "Slave Forward Lo" output at terminal 233 and a "Slave Reverse Lo" output to terminal 234 respectively interconnecting with the "Forward Lo" input 23 and "Reverse Lo" terminal 24 in the slave circuit of FIG. 15.

Additonally, output Q and $\overline{Q}$ from 204 are steered by the arry of AND Gates 207, 208 and the OR Gate 209 to provide pulses via inverter 210 and conductor 211 to corresponding power transistor amplifying means 212 and 213, the outputs of which appear at motor drive terminals 214, 215 for energization of two windings of motor 30.

Another two motor windings then are energized by pulse outputs from Q and $\overline{Q}$ terminals of Flip Flop 204 applied via a similar array of gates 220, 221 and 222 driving amplifiers 225, 226 via conductor 223 and inverter 224 providing the outputs at another pair of motor drive terminals 227 and 228.

The remaining four windings of motor 30 are pulsed under control of the slave subcircuits of FIG. 15 responsive to signals on either the "Slave Forward Lo" or "Slave Reverse Lo" input terminals 223 F or 224 R from the corresponding outputs 233 or 234 of FIG. 14, along with signals from master unit outputs (FIG. 14) to inputs bracketed at 230, 231 and 232 from its circuit board terminals 26, 27, and 28, in response to which the array of AND Gates 240A to 240D and OR Gates 240E to 240F will be switched by the JK Flip Flop 240G under control of clocking pulses via gates 244, 245, to apply sequential inputs via inverters 247A and 247B to corresponding transistor amplifier units 248A and 248B with resultant power pulse outputs on motor drive terminals 250 and 251 providing driving pulses for two more of the remaining four motor windings.

The last two windings of motor 30 are pulsed in sequence (FIG. 15) by identical switching and steering operations afforded by the similar array of gates 241A to 241F and the associated Flip Flop 241G driving two remaining transistor amplifiers 248C and 248D through inverters 247C and 247D to provide power outputs at terminals 252 and 253.

In the block diagram of FIG. 8, the circuitry of FIGS. 14 and 15 is represented by the two translating circuit cards TC-1 and TC-2 with outputs via cable MC-1 connecting with the winding terminals $\overline{D}$, $\overline{B}$, $\overline{C}$, $\overline{A}$ and D, B, C, A, of motor 30 for energization in the phased order AC, BD, CB $D\overline{A}$; BD $\overline{A}\overline{C}$, $\overline{D}\overline{A}$ $\overline{C}\overline{B}$; etc. repetitiously. Identical master and slave translating circuitry represented by cards TC-3, TC-4 connects via cable MC-II to the like terminals of motor 40 for energizations of the windings in the same phasing order Since the two motors 30 and 40 are activated from the same master source of drive pulses, and each motor is locked into the requisite phasal energizing sequence of its multiple windings by the described master-slave translating means, the motors' output shafts tend to rotate in step at their respective preset ratio speeds.

LOGIC SUBCIRCUITS FOR STEP BY STEP AND AUTOMATIC CONTROL

FIGS. 16-A through 18 depict related logic subcircuits having inputs and outputs respectively identified by legends for utilization and interconnection to produce the described machine operations in both step by step and automatic duty-cycle sequence; it being understood that such circuitry is intended as illustrative rather than limiting except as may be specified in the appended claims, and accordingly is subject to variation by those skilled in the art.

Specifically, FIG. 16-A provides a terminals A11, A12 the "Forward" and "Reverse" High signals for advancing and returning the carriage slide, together with a "Reverse" Low supervisory signal at output 116, the forward travel being governed by gates Z51A and Z52A from inputs bracketed at 121 including "Wheel On" Low, "Slide Forward" Low, and the "Plunger-Returned" Limit Switch 57 (also referred to in the logic legends as the "Unload" signal to distinguish it from the forward loading condition of the plunger) from the output of gate Z38C, responsive to gating by Z38A conditioned by the Automatic Mode Switch 75B, contacts 75A (FIG. 9), such that the loading plunger must be returned, the slide forward, the grinding wheel on and the machine cycled in order to produce the "Forward" High signal at A11 which will start the carriage forward.

Similar control of the "Forward" High signal is available from the manual "Forward Jogging Push Button" Switch 92A in applying a Low via inverter Z37C to gate Z38B and gate Z51A via Z38C, which likewise produces the "Forward" High at A11 for jogging in setting up or special work.

To return the slide home, the "Reverse" High signal at the logic board terminal A12 requires a "Wheel-On" input to gate Z4AA; closure of the "Slide Forward" and "Plunger Returned" limit switches, and operation of the "Reverse Push Buttom" switch 92B (FIGS. 2, 7 and 9), together with existence of either an "Automatic" High and "Reverse" Flip Flop signal on the input of gate Z19B if in the automatic mode, or an operation of the "Reverse Push Button" switch to produce the reversing signal responsive to the resulting states on gates Z19A and E, and Z4A, Z45 and Z52B. The "Reverse" Low on terminal 116 is an availability signal for supervisory application within the logic.

FIG. 16-B provides, via gates Z10A and Z24B, respectively, the enabling "Forward" High and "Forward"Low Flip Flop signals at output terminals 133 and 134 dependently upon the presence of designated signals at the bracketed inputs 135, including "Safe" High and "Half Done" Low signals from the logic system operative via gates Z19C, Z31D, and Z31E to permit indexing to finish a second flute provided the wheel is up, the plunger returned, and the carriage returned home in the automatic mode, such input signals being provided by the outputs 118, 119 and 120 of FIG. 16-C.

FIG. 16-D provides two supervisory signals including a "Cycle On" High at output 122 governed by the bracketed inputs 124 and gates Z17C, Z17D, Z31, Z3 and Z10B with inverter Z24A providing at output 123 an "Unload" signal which will permit the chunk to open or unload after the indexing "Count Out" starts the last flute and the latter is completed with return of the carriage slide, these latter operations involving also the operation of subcircuit 16E in which the bracketed inputs 127 will produce a "Reverse" Flip Flop High gate Z10C at output 125, provided the "Count-Out" is completed and the carriage slide returned to operate its limit switch and enable Z10C via inverter Z24B, three-input gate Z51B, inverter Z18A and enablement of gate Z10D to provide the "Done" High output 126, indicating completion of the last flute with the steady rest going down and the chuck opening responsive to output 128 from AND gate Z4A enabled via inputs 129, 130 and AND gate Z44 enabled by a "Chuck-Open Push Button" Low and "Load Remind" Low from inputs 131 and 132.

FIG. 16-F also governs the "Steady Rest" and "Chuck Opening" signal at terminal 128 of FIG. 16-E with respect to automatic and step by step operating conditions through the designated interconnection from gate Z3C in FIG. 16-E to one input of the OR gate Z3B in FIG. 16-E with the object among others of requiring that there be a step by step or "SS" Low manual signal and a "Done" High signal input to gate Z11A and a "Done" High on gate Z11A or a "Chuck Open" High on gate Z11B to to enable the AND gate Z3C signal extended back to FIG. 16-F, as aforesaid, via the NOR gate Z51C. Two delay signals are provided at outputs 133 and 134 from the outputs of a JK Flip Flop Z28A clocked by "Timer" Z21A triggered by a "Load" Limit Switch Low at input one of these delays being extended as an input to the aforesaid "Chuck Open" gate Z11B to assure that the "Loading" plunger is back before the "Steady Rest" goes down and the Chuck opens.

FIG. 17-A provides a second source of supervisory delay signals at terminal 136 from the inverted output Q of Flip Flop Z28B triggered by a "Delay 1" High from FIG. 16-F. FIG. 17-A is also the source of a "Load" High signal at output 137 from gate Z4B enabled by bracketed inputs 139 when there is present a "Chuck Open" High and an "Auto" High on gate Z11B or an "Auto" Low and "Load" Push Button Low via inverter Z18C as inputs to gate Z11C providing another input to the NOR Gate Z25A. A "Load" Limit Switch Low and "Forward" Flip Flop Low on inputs 140 also supply a "Loaded" High signal at output 138.

FIG. 17-B provides "Chuck Closing" High and Low signals at outputs 142, 143 from gate Z32C and inverter Z18E respectively dependently upon an "Auto" High and "Chuck Closed" Push Button Low on gate Z32A or "Auto" Low and "Delay 1" Low on gate Z32B in the bracketed inputs 141. This circuit further provides "Unload" Low and High signals on outputs 145, 146 governed by bracketed inputs at 144 including an "Auto" Low and an "Unload" Push Button Low via Z18D as inputs to gate Z25D or an "Auto" High and "Delay 2" High as inputs to gate Z46, and an "Unload" Limit Switch Low, "Auto" High via gates Z39A, Z39B.

The "Index" High signal is also provided in FIG. 17B at output A13 from a gate Z32D and inputs "Auto" Low and "Slide Forward" Limit Switch Low, for supervisory use in the logic system.

FIG. 17-C provides logic signals for controlling the steady rest and grinding wheel power and up-down movements with a Steady Rest "Up" High at output 150 from gate Z52 when the "Chuck Open" High and "Unload" Limit Switch Low inputs are present. The "Wheel On" High at output 151 and "Wheel Down" High at output 152 result from bracketed inputs 149 such that an input "Wheel On" Low inverted by Z53A, "Unload" Limit Switch High, "Reverse" Low to gate Z45, and "Auto" High and "Forward" Flip Flop High via AND gate Z46B and NOR gate Z46C, produce the "Wheel Down" Low output 152 subject to manual inputs "Wheel Down" Push Button Low at Z53, gates Z46D and Z4C; and "Auto" Low and "Wheel Up" Push Button Low via gates Z39C and Z4C.

The previously mentioned "Load Remind" signal is produced at output 153 by Flip Flop cross-connected gates Z44A, Z44B controlled by a "Load" High input via inverter Z18, and a "Load" Limit Switch Low.

FIG. 18 depicts the Index Pass counting subcircuit for counting the number of times the carriage goes forward to provide a "Count Out" High output 154 to stop the cycle as the result of outputs from "Decade Counter" Z47 controlled by the designated inputs from the "Forward" Flip Flop Low and a "Done" High via inverter Z40A and gate Z44 in conjunction with an "Auto" High. The counter output are inverted by Z40B, Z40C, Z40D, Z40E and fed into comparator Z54 into which the binary coded digital settings or outputs of the "Index Number Switch" 74 are fed from FIG. 2 to terminals (B23) . . . (B30), FIG. 11, such that when the comparator detects a number of forward carriage passes equal to the setting of the digital switch the "Count Out" signal appears at 154 to terminate the cycle.

The "Load Remind" Output 153 (FIG. 17-C) will automatically inhibit the loading operation following a manual operation of the load plunger on the assumption that the chuck has been loaded manually, whereby to prevent wasting the loaded work piece.

MODIFIED SWING-HEAD EMBODIMENT

The form of the machine depicted in FIGS. 19 through 22 extends the capabilities of the basic machine heretofore described by providing an automatically shiftable or swinging tool head 12X, FIG. 19, in place of the manually-set head 12 previously described, with the further inclusion of pneumatic cylinder means and supplemental logic programming the swing head for automatic cross-cutting, spiral-relieving, and other operations, including particularly reverse spiral fluting, in accordance with which the grinding wheel 13X is required to shift left or right to pre-selected opposite cutting positons crosswise of the axis of the spindle and work.

In view of the substantial identity of the basic machine components and functional control aspects common to both forms of the machine, descriptive details of similar and counter part elements and circuitry are not repeated in the following description of the modified embodiment, identical or essentially analogous components being identified, instead, where appropriate, by the same reference numerals used in describing the basic machine but further distinguished by addition thereto of the suffix —X—.

In accordance with the block diagram of FIG. 24, the swing-head embodiment employes the essential machine structure and control features heretofore described, and substantially identical duty-cycle programming logic governing the basic machine operations under control of substantially the same limit and manual step by step switch means but augmented by supplemental logic and supervisory switch means to implement the swing-head cross-cutting operations, as will further appear.

The motors MX-1, MX-2 in FIG. 24 are of a type operating at higher power and speed levels to meet the heavier torque and added fluting time required for swing-head capabilities, but are likewise activated by digitally-set binary pulses in a master and slave servo relationship, as will more fully appear.

Referring to the front view of the modified machine, depicted in FIG. 19, the swinging tool head 12X and its grinding wheel 13X and motor 14X are mounted as a unit on a swing table 300 which lies behind an end block 301 (see also FIG. 20) fixed on a cross slide 302 shiftable laterally of the spindle axis responsive to turning of the usual cross-feed screw by handwheel 304.

Fixed in a cylinder block 305 secured to the carriage slide below said end block are right- and left-table-driving air cylinders 307A and 307B, each fitted with brackets carrying a pair of parallel outrigger rods 308A, 308B, respectively supporting corresponding table limit switches 309A, 309B on opposite brackets 310A, 310B, which are positionable along said rods, and which carry appertaining adjustable spring-cushioned stop buffers 311A, 311B, engageable by the corresponding coupling clamps 312A, 312B of the cylinder plungers on arrival at the selected outer limits of travel as determined by setting of the corresponding limit switches. Each spring stop or buffer is equipped with a fine adjustment screw 313A, 313B to position the same for precise actuation of the limit switches.

The respective plunger coupling clamps 312A, 312B are attached to a corresponding end of a long linear gear rack 316 slideably seated in the fixed table block 301 in driving mesh with a confronting segment gear 318 (FIG. 20 also) seated in the rounded and recessed lower front end portion of the swing table such that reverse displacements of the linear gear rack, responsive to corresponding activation of the table air cylinders, will swing the table correspondingly to the right or left of its central zero or "No Angle" position about its pivot 319 on the cross carriage slide.

As in FIG. 20, an arcuate T-slot 320 is provided in the fixed end block to seat small adjustable right- and left-table stops 321 which can be set to limit the range of table excursions in correspondence with the setting of the right- and left-table limit switch assemblies 309A, 309B.

Each coupling clamp on the linear gear rack is fitted with an offset switch-actuating tappet finger 315A, 315B, aligned with the actuating plunger of the corresponding limit switch to operate the latter on approach of the corresponding air-cylinder plunger to the set outer limit of its travel.

As viewed in FIGS. 20 and 21, the swing table comprises an elongated heavy plate 300 turning about pivot 319 fixed in the cross slide, there being an offset roller means 324 in the form of a ball-bearing or like anti-friction roller affixed at one rearward side of the swing table to roll upon a machined glide plate 325 fitted onto the carriage slide, and also rolling in extended travel upon an arcuate glide wing 326 pivotally mounted as at 327 on one of the sides at the rear of the carriage slide and having adjustable support at its opposite forward terminus upon the end of an adjusting screw 328 threaded into a bracket 329 also attached to the slide, whereby the glide wing can be levelled relative to the glide plate, such arrangement affording an increased range of travel for the table to the extent of 45° in either direction from the centered "No-Angle" position.

The grinding head 12X, as seen in FIGS. 20 and 21, comprises the large wheel motor 14X having an elongated cylindrical shaft throat 14XY clamped between heavy upper and lower yoke blocks 330 slideably seated for vertical movement between upright slideway plates 331, secured to the table by gussets 332, and supporting at their upper reaches a pneumatic head cylinder 83X, the plunger of which is pivotally connected as at 333 to the upper yoke block, there being an upper-limit head switch 335 (FIG. 20) adjustably positioned above the motor body for operative engagement by the latter on movement of the motor into the uppermost permitted position.

Means for automatically modifying the depth of cut of the grinding wheel for certain types of work, for example in forming routers and the like, comprises (FIGS. 20, 21) a laterally-shiftable gauge bar 337 slideably seated in slot means at the rear of the slideway uprights, and urged into a normal position by spring 338 to thrust one of the bar ends 337A into a normal triggering position beyond the slideway for triggering engagement with an adjustably-positionable trigger roller 339 (FIG. 21) carried on post means 340 on the machine base and engaged by the bar end when the table swings to its limiting position in that direction, whereby the gauge bar is shifted toward the left oppositely against an adjustable stop pin 341 to displace an adjustable drop screw 342 which determines the descent and cut of the wheel.

Threaded into the gauge bar (FIG. 20) is an adjustable drop screw 342 engaging the underside of the motor body in the normal position of the gauge bar to elevate the motor, and therefore the grinding wheel, by a slight amount in the order of a few ten-thousandths-of-an-inch, such that when the bar is shifted, on striking the stationary trigger roller 339 mounted on the machine base, the resulting displacement of the drop screw from beneath the motor will cause the latter and therefore the grinding wheel to descend by the pre-set fractional amount, thereby automatically increasing the depth of the wheel cut slightly as a function of swinging of the head in one direction. This depth of cut control means is intended for use in making cross-cut tools which may require a deeper cut in one direction than in the other. As will appear hereafter, still another depth-of-cut means is provided for operation in both the right and left spiral leads and requires repeating the carriage passes a number of times in both directions in accordance with the setting of a digital switch for such purposes.

The tool head may be adjusted up or down in setting the grinding wheel for the primary depth of cut by turning the ball handles 343 of a long vertical head screw 344 working in tube 345 bracketed to the slideway by plate 346, with the lower exposed end 344A of the screw bearing upon a hardened wear plate (not seen) on the top of the glide roller bracket 324, there being a lateral extension 330A from the lower yoke block upon which the lower end of the screw tube is seated, and the screw itself threading into said block extension so as to thrust its said end against the roller and thereby force the yoke assembly up or down as the screw is turned for the purpose of pre-setting the working elevation of the wheel for depth-of-cut and diameter of the work piece.

The head will also be raised or lowered relative to the work by its air cylinder 83X which can be activated manually at the machine by operation of a head cylinder air solenoid switch 348 seen in FIG. 20 but omitted for clarity from FIG. 19, this pneumatic cylinder being also operable in automatic duty cycling to be described.

The descent of the head assembly to engage the wheel with the work is buffered and stopped by engagement of the underside of the underside of the bracket plate 346 with the plunger of a dashpot 347 adjustably attached to the slideway structure, FIG. 20.

Thus, the swing-head assembly 12X comprising the grinding wheel 13X, motor 14X, air cylinder and table-pivoting gear means 307, 316, 318, 321, and head cylinder 83X and the associated adjustment and control appendages 309, 311 carried with the swing table 300 and cross slide 302, can be turned automatically as much as 45° to the right or left of a "No-Angle" centered position in which the plane of the grinding wheel would be parallel with the axis of the work piece, as in cutting straight flutes, to any pre-selected angular position crosswise of that axis, as determined by the setting of stops 321 for engagement by the table index stop 322, as in grinding right or left cross cuts, spiral fluting, and relieving, and various other abrading operations.

In other respects, the modified structural form of the machine shown in FIGS. 19 through 25, particularly, is substantially the same and may employ substantially the same step-by-step and duty-cycle logic for the basic machine functions in conjunction with supplemental logic required by the swinghead modifications and represented by inclusion of an added logic card L-3 in the block diagram of FIG. 24, and specifically illustrated in the subcircuits detailed in the modified logic of FIGS. 26-A to 26-C, along with the modified motor-drive and control logic and Indexing subcircuits of FIGS. 28-A through 31.

The automatic cross-cutting functions can also be utilized in dressing, relieving, and backing-off operations on flutes which are already cut and which may be of either right- or left-hand lead, but since such pre-fluted drills will fall from the magazine into the loading plunger seat in haphazard angular attitudes, it becomes necessary to turn them into proper starting position immediately after the chuck closes and before the spindle starts to rotate, and for such purposes a supplemental spindle-orienting means is provided in the form of a small electric motor 350 driving the work spindle through clutch means 351 under control of manual switch means 349, FIG. 19, and including mechanism (not shown) operative to stop the motor when the pre-fluting is in proper starting position for engagement by the grinding wheel.

A significantly increased working load is imposed upon the carriage and spindle motors by the swing head operations, which commonly involve larger sizes of drills, routers, reamers and the like, with the result that these motors must work at considerably higher current levels in the order of 10 amperes, by reason of which motors M-1, M-2 are replaced by high current printed-circuit type motors MX-1, MX-2 capable of working in a servo mode at higher shaft speeds without losing synchronism, so that they can maintain the pre-set carriage and spindle speed ratios under control of digitally-set binary coded drive pulses as in the case of the motors M-1, M-2.

MODIFIED SWING HEAD CONTROL AND DRIVE MEANS

As indicated by similar reference numerals distinguished by the suffix —X—, FIG. 22 substantially duplicates the schematic plan of the basic machine components, limit switches, air cylinders, and connection terminals, such as are shown in FIG. 2, but is modified by replacement of the manually-set grinding head 12 by the swing head 12X and appertaining limit switches and air cylinders, along with use of the high-torque, high-speed printed-circuit motors MX-1, MX-2 in substitution for the wire-wound motors M-1, M-2 of FIG. 2, with appropriate cable terminals for interconnection with the duty cycle and motor drive subcircuits in the control unit 70X.

The modified control unit 70X shown in FIG. 23 includes all of the manual controls or their substantial equivalents found on the panel of the unit 70 shown in FIG. 7 to the extent indicated by similar reference characters designated by the suffix —X—, to which controls are further added on the modified control panel a toggle switch 353 designated "Auto Load" to make automatic loading of the blanks optional for set-up purposes, together with an "On/Off" switch 359A associated with a newly-added thumbwheel switch 359 operative to set the number of "Reverse Flutes" required to be ground in a given duty cycle.

The two previously-described table-to-spindle speed ratio switches 71, 72, for the helix or lead angle, found on panel 70 of FIG. 7, are replaced on the panel of unit 70X by the "single-entry" thumbwheel switch 354 designated by the legand "Lead 1/N," by which this speed ratio can be set more conveniently with entry of only the denominator value "N," since the carriage speed is adjusted to a relatively fixed standard rate in this embodiment to service as a "Velocity Reference" speed, as explained more fully hereafter. Further, the indexing control 73 previously designated in FIG. 7 as the "Index Distance" switch, is replaced in FIG. 23 by the thumbwheel switch 355 analogously designated "Index Pulses" which is determinative of the identical index-distance parameter set by digital switch 73 in the embodiment of FIG. 7.

Switch 356, designated "Reverse Index Pulses," sets the index distance pulses needed for the reverse flutes, the number of which will be predetermined by the setting of the "Reverse Flutes" switch 359 (when enable by switch 359A), while digital switch 358 determines the number of regular (e.g. right-hand) flutes. If deeper fluting cuts are required, the carriage passes may be repeated the number of times set on the "Flute Passes" switch 357.

By reason of the fact that the modified machine also performs all of the grinding operations of which the basic machine is capable, the substantial part of the operating and duty-cycle logic for the latter, as represented by the logic cards L-1, L-2 of FIG. 8, and the corresponding detailed logic subcircuits of FIGS. 16A through 18, may be utilized in the modified control unit 70X of FIGS. 23 and 24 in accompaniment with added logic represented by logic card L-3, which provide general supplemental control for the swing-head functions, in accordance with the subcircuitry of FIGS. 26A through 31.

Referring to the block diagram of FIG. 24, the substituted motors MX-1, MX-2, are of a known variety, having flat, commutator-fed printed-circuit type "Armatures" rotating in a strong permanent-magnet field (not illustrated) at high power levels, these motors being driven by digitally-set binary actuating pulses in a servo mode for which purposes each motor has in driving association therewith a correspondingly designated tachometer-generator and an optical encoding means of known character, together with respective solid-state amplifying means comprising a part of each motor unit and therefore embraced within respective broken-line enclosures designated 30X and 40X to identify the complete individual motor units in a form in which they are obtainable commercially.

Continuing in view of the block diagram of FIG. 24, the carriage motor MX-1 will be energized on closure of the panel switch 352 by respectively positive or negative speed-control voltage for clockwise or counter-clockwise rotation from speed control potentiometers 79AX or 79BX via conductor 361 and power amplifier 362 to the carriage motor of unit 30X thereby causing the appertaining encoder to apply appropriate forward or reverse drive pulses via Decoder 363 and gate 364 to a Frequency Divider 365 which produces a resultant binary pulse drive output in accordance with the setting of digital switch 354 acting thereon via conductor 360 with the resultant binary-coded output applied in turn via conductor 366 to an Up-Down Counter 367, the output of which is converted to corresponding analogue voltages by a digital to analogue converter 368 and applied to motor MX-2 via Power Amplifier 369, biased by the MX-2 tachometer output via conductor 371.

Forward and Reverse direction and drive of the spindle motor is regulated by the MX-1 tachometer-encoder, directional Flip Flop 372, and an associated Decoder 363 applying via OR gate 364 an input to Frequency Divider 365 governed by the setting of the binary-coded digital ratio switch 354 via conductor 360 to provide a resultant driving output applied via conductor 366 as one input to an Up-Down Counter 367, along with directional signals from the Flip Flop via conductor 373, with Reverse and Forward Regulating Pulses from the appertaining encoder applied as further inputs to the Up-Down Counter to produce proportionately varied driving voltage to the motor as aforesaid, whereby the position of the spindle is maintained at all times precisely in step with the carriage motor at the set ratio 1/N. The nominal or reference velocity of the carriage motor, represented as the numerator "1" in such ratio, is derived from the velocity reference Output 433 of FIG. 28-B and may be set by the potentiometer 79AX at about 4,000 driving pulses per minute and will normally remain at this value indefinitely unless adjusted for special jobs or compensation for drift or other ambient conditions, so that entry of only the denominator digits "N" into thumbwheel switch 354 will be required usually to change the lead angle.

As in the case of the first-described embodiment, the reverse travel of the carriage is set by potentiometer 79BX to produce a faster homing speed in reverse direction to economize time in the indexing operations and speed up the production rate of such machines.

MODIFIED LIMIT AND MANUAL SWITCH MEANS

The circuit connections from the limit and manual control switches and air cylinders of the basic machine, which are extended to the control unit 70 according to FIGS. 2 and 9, together with a substantial part of the control logic heretofore detailed in FIGS. 16-A through 17-F, are also utilized in the swing head embodiment and reappear (identified by suffix-X- reference characters where necessary) in the modified counterpart control switch diagrams of FIGS. 22 and 25 in conjunction with the newly-added supplemental limit switches and manual switches and air cylinder means for the grinding head and its swing table, including specifically a head limit switch 335 signalling the raised or "Head Up" condition of the grinding wheel as a condition precedent to permitting any change in the angle of the swing table, and providing a "Head Up" High output at terminal 336 in FIG. 25.

Swing table limit switches 309A, 309B, designated "Angle Left" and "Angle Right" in FIG. 25, are connected in series such that when both are closed a "No Angle" signal is produced at output 370 indicating that the table is locked at some position between its limits and therefore can be permitted to move responsive to a move signal.

Control of actuating air to the two swing table cylinders is provided responsive to "Swing Signals" from the logic cards at one or the other inputs 334 respectively resulting in a "Solenoid Position 1" High Output 314, or a "Solenoid Position 2" High Output 317, FIG. 25.

Since the control switch arrangements of FIGS. 2 and 9 are substantially duplicated in FIGS. 22 and 25, and the duty-cycle logic of FIGS. 16-A through 17-F is but slightly modified for the swinghead operations, only the needed supplemental duty-cycle logic changes made in FIGS. 16-A, 16-E and 17-C will be described in detail hereafter, as shown in the modified counterparts thereof depicted in FIGS. 26-A, 26-B and 26-C, it being observed that the modified motor-drive and speed regulation logic for the substituted printed-circuit motors is to be separately described hereafter.

SUPPLEMENTAL LOGIC SUBCIRCUITS

FIG. 26-A duplicates FIG. 16-A and adds thereto two gates 375 and 376 governed by the newly added "No Angle" and "Head Up" signals in bracketed inputs 377 to provide the previously-described outputs at terminals (A11X), (A12X) and 116X. No changes are necessary in the previously described companion subcircuits FIGS. 16-B, 16-C or 16-D.

FIG. 26-B substantially duplicates FIG. 16-E but includes an additional gate 378 in the control of the steady rest and chuck output 128X for use with the optional "Auto" Loading switch 353, and requires supervisory inputs from the "No Auto Load" switch Low and the "Chuck Open" Push Button Low signal and the "Load Remind" Low signal, with an extension via conductor 147 into the circuit of FIG. 16-F to connect with conductor 179E therein.

FIG 26-C is a modification of FIG. 17-C to the extent that it substitutes an AND Gate 391 for the inverter Z53B of the latter Figure in order to incorporate the newly-added "No Angle" control signal for the swing table limit switches to assure that the head does not go down while the table is in motion. If both of the table limit switches 309A, 309B are open (FIG. 25), the table is either in motion or can be permitted to move; but if one of these switches is closed and the other open, the table is locked in some swing position and can only be moved back in the direction opposite and the wheel will not be permitted by the logic to go down until the state of the table is confirmed by the "No Angle" supervisory signals.

In order to permit use of the machine for thread cutting, it may be desirable to inhibit automatic part loading, for which purposes the newly added "Auto Load" supervisory panel switch 353 in OFF position provides at logic circuit board terminals 394 designated "No Auto" -L-, in conjunction with the "Cycle Start" Push Button signal via gate 392 and a "Loaded" High signal on gate 393, produces the "X-Loaded" High output 395, indicating special loading which will eliminate automatic loading in that cycle.

FIG. 27 shows partially new subcircuitry operative in determining the number of times the carriage passes will be repeated to obtain deeper cuts, according to the setting of the thumbwheel switch 357, and also the number of flutes which will be cut according to the setting of thumbwheel switch 358.

The pass counting means shown at the left of FIG. 27 comprises a comparator 380 providing the "Count-Out" output 154X as the result of matching the bracketed inputs 383 from thumbwheel switch 357 and the output of Decade Counter 381 clocked under control of gate 382 from Strobe Flip Flop 405 and a directional NOR gate 384 governed by inputs "Rev. Flute On Sw." and output signals on conductor 385 controlled by directional Flip Flops 386, 387 and 388.

Decade Counter 381 is set via conductor 389 under control of logic inputs "Auto" High and "Done" High, it being observed that this pass counting means is essentially the same as that described in view of FIG. 18.

The "Rev." High logic input clocks Flip Flop 386 to produce the control output 399 designated "Direction 2" Low constituting the companion rotational controls for the spindle along with the "Direction -1-" signal.

Two further directional outputs 410 and 411 for the swing table driving solenoids respectively designated "Sol. Posn. 2" High and "Sol.Posn.1" High, are provided from the Q and inverted $\overline{Q}$ outputs of Flip Flop 387 dependently as shown upon the supervisory control of the designated inputs from the bracketed logic and switch inputs 390 including "Man'L", "Reverse Flute On L", "Cyc. On Sw.," "Chk. Op.H," and "No Auto Sw. L," together with Angle Right and Angle Left signals via the normally closed series swing table limit switches 309A, 309B to the clearing inputs of Flip Flops 386, 387, and signals from the Multiplexer -MUX- (to be described in view of FIG. 30 hereafter) via conductor 377 to provide setting and clearing signals for Flip Flops 386, 387.

Bracketed inputs 401 (MSD) and 402 (LSD), respectively representative of the most and least significant digits from the flute counting thumbwheel switch 358 to Comparators 400 and 403, when matched by the corresponding Decade Counters 400A and 403A under clocking pulses from Strobe Flip Flop 405 via conductors 383A and 383C, provide the outputs on Conductor 406 to enable AND Gate 407 gating the Strobe pulses for said counters, as well as for counter 381 and for Flip Flop 388.

DECODER AND VELOCITY REFERENCE SUBCIRCUITS

FIG. 28-A details the subcircuit by which the direction of rotation of the servo spindle motor is governed. The encoders referred to under FIG. 24 are of a known type (not illustrated) wherein an apertured light disc rotates with the motor shafting and has two concentric rings of light apertures which are angularly out of phase with each other and through which appertaining photocells are activated to produce pulses which, in the forward direction of rotation conform to a sine wave function, while the pulses in the reverse direction conform to the cosine function.

The decoder 363 (FIG. 24) discriminates by the phase difference which way the shaft of Motor MX-1 is rotating, and the directional Flip Flop 372 accordingly provides a reversing control signal for the Up-Down Counter 367.

As shown in FIG. 28-A, the Decoder comprises a set of three Flip Flops 416, 417 and 418 which may be of the 7474 dual-D, edge-triggered type, connected in an array such as shown with a type 555 timer for delay. The respective sine and cosine pulses from the MX-1 Encoder are applied at input terminals 419A, 419B via Schmitt Triggers 420A, 420B to produce the "Up" counting signal via Gate 421 at Output 422 to provide the "Down" counting signal via Gate 423 at output 424, for directional and drive control of the spindle motor MX-2 via the Up-Down Counter 367. An output "High" 425 is provided from Inverter 426 setting and clearing the signal on conductor 427.

FIG. 28-B depicts the Velocity Reference and stabilizing speed control for the Carriage Motor MX-1, which is governed by "Reverse" High and "Forward" High inputs on conductors 429, 430 respectively activating the photo-diodes 431A, 432A of the two corresponding optical isolators 431, 432 to produce either a Forward or Reverse velocity reference output 433 on conductor 434 from the respective emitter-collector circuits 431B, 432B thereof, the magnitude of which will be governed by the collector-current variations effected by the settings of control potentiometers 79AX and 79BX at the control panel of 70X.

The foregoing isolating means eliminates circuit noise, and includes a further speed and synchronism means stabilizing and preventing creepage of the motors in the idle condition by providing a motor-killing "Hold" to ground 435 on output 436 through the emitter-collector circuit of a transistor 437 rendered conductive under control of a NOR gate 438 resulting from the absence of any drive signals on input conductors 429, 430, whereby any floating idle drive input to the master carriage motor MX-1, and therefore to the slave motor, will be shunted out.

SPEED RATIO INTERPOLATOR

FIG. 29 depicts the subcircuit governing "Forward" and "Reverse" drive, in accordance with indexing supervisory signals and setting of the lead of helix angle (1/N) thumbwheel switch 354, and produces three outputs 440, 441, and 442 respectively designated "Slave Step -L-", "R.Step -H-." and "Direction -1-L-."

The "Slave Step" output 440 appears on conductor 440A from AND Gate 444 which is enabled in part by overflow or carry output on conductor 445 from a set of "Adders" 446A to 446E (e.g. Type 82S83) receiving the bracketed inputs 447A to 447E corresponding to the outputs from the thumbwheel switch 354, each "Adder" having associated therewith a corresponding storage latch or memory 448A to 448E providing clocking signals on conductor 449 for the slave step pulse generating means, which comprises a holding Flip Flop 450 triggering pulse generator 451, the output of which provides one of the two enabling inputs to said AND Gate 444 gating the "Slave Step" pulses, which are held until the next pulse follows, the remaining enabling signal for the gate being derived from the "Blanking," "Straight Flute," and "Forward" logic inputs bracketed at 453.

The "R.Step" output 441 is a bidirectional control signal for reverse fluting and derives from sequenced monostable pulse generators 455 and 456, triggered from the "Up-Down" input signals via conductors 457, 458 and gate 454, and is to be extended into the "Index" logic at terminal 465 in FIG. 31.

The directional output 442 is also derived from the "Up-Down" inputs on conductors 457 and 458 setting and clearing a dual Flip Flop 460 (e.g, Type 7474), providing on conductor 461 one of two enabling inputs to a pair of directional NAND Gates 462A, 462B, controlling a NOR Gate 463 cooperably with the remaining enabling input via conductor 464 to said pair of gates from the "Direction-2-L-" logic input.

The machine can be quickly readied for straight fluting and abrading simply by positioning the swing head in its centered or zero-angle position for which purposes, assuming there will be a plurality of such flutes, the indexing of "R-Step" operations will be the only rotational movement the spindle will take during the duty cycle, so that operation of the "Straight Flute" switch 395S, FIG. 23, to the "ON" position, in conjunction with the state of the input signals bracketed at 453 in FIG. 29, will cause the logic to effect indexing spindle rotation while inhibiting spiral spindle rotation during the straight flute duty cycle.

REVERSE FLUTING MULTIPLEXER

FIG. 30 illustrates a subcircuit which supervises the reversal of fluting in accordance with the direction and number of flutes required, and comprises a set of four Multiplexers (e.g. Type 8233) 466A to 466D, each having two sets of inputs for right- and left-hand flutes including "Forward" binary thumbwheel inputs 8-4-2-1 designated 1-IX, together with the "Reverse" binary inputs designated 2-IX, to which are applied the most and the least significant digits (MSD) and (LSD) respectively, from the "Index" -1 and "Reverse Index" -2 thumbwheel switches 355 and 356, to produce resultant bracketed outputs 467A to 467D for extension to the indicated circuit board terminals, thereby providing bi-directional control signals for extension to the corresponding terminals in other subcircuits including the "Indexing" logic of FIG. 31, to be described.

Two additional Multiplexing Blocks 469A, 469B have binary inputs bracketed 470A, 470B from the "No. Flutes" thumbwheel 358, providing bracketed outputs 471A, 471B connecting to the corresponding terminals of the comparators in FIG. 27.

INDEXING LOGIC

FIG. 31 depicts substantially the identical indexing logic shown in FIG. 13, as indicated by the suffic -X- reference characters, and differs from FIG. 13 only in the elimination of the 7404 type inverters, such as Z9A to Z9E and Z12E between the counters and comparators which are used in that embodiment to pull up the levels to +5. volts, whereas in FIG. 31 these points are tied to ground internally for this purpose.

The operation of FIG. 31 is otherwise the same as that previously described in that the "Index" signal at logic input (A4X) in FIG. 31 likewise clocks the Flip Flop Z1X and starts the one-shot timer Z2X to provide the blanking signal on conductor 113X appearing at output 114X when the "R.Step" input from FIG. 30 is present on conductor 477, to enable the gate Z8BX, the output of whch on conductor 478 clocks the "Decade Counters" as the result of input on the NOR Gate Z28AX from either the "Auto" input A5X or the output on conductor 480 from the timer via gate Z8AX.

Blanking stops the "Up-Down" counting by interrupting the resetting operations thereof and starts the counting of the sample pulses from the one-shot timer Z2X, and when the comparator count-out is reached the count-out gate stops the blanking and the resetting of the counters and rotation of the spindle resumes at the preset index distance.

We claim:

1. A machine for spiral grinding and fluting wherein a reciprocable carriage supports a rotary work spindle with automatic chuck and chuck-loading means, characterized in that separate pulse-activated motors respectively drive the carriage and spindle; a source of drive pulses for said motors; first circuit means including digitally presettable switch means operative to preset digital values representing the speed and direction of motor operation with means converting said values into binary motor pulsing values; second circuit means operative under control of the first circuit means to apply said binary pulsing values to each motor to produce directional and speed response thereof in accordance with the setting of said presettable switch means; third circuit means including further digitally-presettable ratio switch means operative to control the speed of said motors in desired ratio to govern spiral displacement of the chucked work piece relative to a tool with respect to which the carriage travels from a home position to an advanced working position; fourth circuit means operative responsive to a cycle start switch to initiate and conclude predetermined duty-cycle operation of said machine in accordance with setting of said presettable switch means in each of which said carriage advances from said home to said advanced positions and returns to home position a predetermined number of times in each cycle and said spindle rotates a chucked work piece as aforesaid during at least a predetermined portion of the forward working pass of the carriage; fifth circuit means operative to preset the number of times said carriage will advance in working passes in each cycle, and to cause said chuck means to discharge the work piece at the conclusion of the last pass.

2. The machine of claim 1 further characterized by the provision of sixth circuit means cooperative with said second circuit means and including reverse speed control switch means operative to cause said carriage driving motor to drive the carriage in the homing direction at a rate which is substantially greater than in the advance direction.

3. The machine defined in claim 1 further characterized in that there is provided an indexing subcircuit operative during each homing operation of the carriage except the last one preceding conclusion of a duty cycle, to stop the spindle, count representative spindle motor drive pulses and the carriage drive pulses and compare the said pulses until a value is detected corresponding to the index distance which is required to restart the spindle and cause the work to engage the tool at a predetermined angular indexing point; and index-distance switch means operative to preset the number of said indexing operations and the required index distance governing such indexing operations in any duty cycle.

4. A grinding and fluting machine according to claim 3 wherein said tool comprises a grinding wheel and tool head means supporting the same for movement to and from engagement with the chucked work piece, together with electrically controlled tool head moving means operative to effect said work engagement movements.

5. The machine of claim 4 further including separate electrically controlled activating means for certain machine components including said motors, said chuck and loading means, and said tool head moving means, together with machine limit switch means, manually operable switch means, and logic subcircuits having connections with said electrically controlled activating means to effect predetermined sequential operations thereof in the aforesaid duty-cycle operation in an automatic mode, or selectively manually-controlled operations in a step by step mode.

6. The machine defined in claim 1 further characterized in that said source of drive pulses for the motors comprises separate frequency generators for forward and reverse operation of the motors, together with speed control means including frequency dividing means governed by said presettable digital to binary switch means in effecting said forward and reverse motor operations.

7. The machine as defined in claim 3 wherein said indexing subcircuit includes pulse counting means, pulse comparator means; a source of sample drive pulses governed by count pulses from one or the other of said frequency generators, said counting means having a setting and a resetting function, means normally disabling said resetting function whereby to inhibit the counting function; a source of reset blanking pulses, and circuit means enabled by a forward carriage limit switch for enabling said blanking pulse source to start counting operation of the counting means, said sample counting pulses from said index distance switch being fed into said comparator which on detecting equality thereof disables said blanking pulse source to stop said counting function and restart the spindle in an appertaining forward working pass of the carriage with the angular position of the chucked work piece rotated to a newly indexed starting position relative to said tool by the angular amount corresponding to the setting of the index distance switch means as aforesaid.

8. A grinding and fluting machine according to claim 7 in which said indexing subcircuit includes digital to binary flute-counting switch means presettable to determine the number of flutes to be ground in a duty cycle; index pass counting means governed by forward carriage limit switch means to count the number of forward carriage passes; comparator means operative to compare the number of forward carriage passes with the number of passes signalled by said flute counting switch means and terminate the duty cycle on detecting equation between said numbers.

9. The machine according to claim 1 wherein said motors are responsive in speed to pulse frequency and are driven in common by pulses from said source of drive pulses applied in a predetermined phasal relationship to multiple drive windings in each motor.

10. In the machine according to claim 9, the said windings in each motor being respectively activated by drive pulses from said common source through the intermediary of an appertaining translating circuit operative to amplify and steer the appertaining pulses in the requisite phasal order into the winding thereof, whereby said motors are constrained to operate in phase step with respect to said common drive pulse source and therefore in respect each to the other.

11. The method of indexing the work spindle in a spiral grinding machine having a reciprocable carriage and a rotated work spindle travelling therewith, together with separate binary pulse-activated motors for driving the carriage and spindle, said method comprising, namely: travelling the carriage by a corresponding motor in a first forward working pass while rotating the spindle by the other motor; operating a forward limit switch by the carriage at the completion of said first pass; stopping the spindle motor only and reversing travel of the carriage back to a home position as the result of said limit switch operation; operating a home limit switch by the carriage and causing restarting the carriage forward on a further working pass; counting the binary drive pulses for the carriage and comparing said count with an index distance binary count determined by presetting a digital to binary index distance switch and restarting the spindle rotation on detection of equation between the compared counts, said index distance switch producing binary pulses in accordance with the presetting thereof which constitutes the additional number of pulses required to turn the work piece into a predetermined newly-indexed starting position relative to a working tool which is a predetermined angular distance away from the angular position on the work piece last engaged by the tool in the preceding pass.

12. The method according to claim 11 further characterized by the added steps of predetermining the number of indexing operations to be performed by terminating the forward working passes of the carriage under control of a presettable digital to binary switch means in which the desired number of indexing operations is entered digitally, affecting a binary count of the number of working passes made by the carriage responsive to operations of said forward limit switch; comparing said pass count with the number of pulses from said digital to binary index switch means; and stopping the carriage motor in a home position under control of said home limit switch as the result of detection of equation between the compared pulse counts.

13. In a spiral grinding machine the combination with a carriage reciprocable between an advanced and a home position and carrying a rotary work spindle adapted to hold work for movement relative to a grinding wheel carried by a tool head, of separate motors driving the carriage and spindle reversely under control of digitally-coded binary pulses including presettable digital to binary coding ratio switch means operative to change the speed ratio between said motors; pass-counting digital to binary switch means operative to determine a set number of working passes of the carriage; index-pulse digital-top binary switch means operative to rotate the spindle to predetermined angular indexing positions in successive carriage passes following a first such pass; limit switch means operable by the carriage in forward and home positions; logic subcircuit means including duty-cycle starting and terminating means and connections with said limit switch means and operative to cause said carriage to make a preset number of working passes from home position and return thereto, and to index the spindle a preset number of times as a function of return of the carriage to home position in successive working passes thereof following a first such pass in a given duty cycle; together with drivepulse counting means and index logic means operative responsive to operation of the forward limit switch means as aforesaid to stop the spindle rotation and restart said rotation in each indexing operation dependently upon the setting of said index-pulse switch means and comparison of resultant binary pulses therefrom with the counted number of drive pulses sensed following said reversal of the carriage in the appertaining indexing operation, such that the restarting of the spindle as aforesaid will rotate the spindle on restarting to lodge the work in a certain indexed angular starting position relative to said grinding wheel different from the position thereof at the time the spindle is stopped, the angular magnitude of which corresponds to the setting in terms of index pulses of said digital index pulses switch means.

14. The machine of claim 13, further characterized in that said tool head is movable to and from engagement with a work piece carried by said spindle, and said logic subcircuit means is operative in each duty cycle to cause said head to move the grinding wheel into engagement with the work at a predetermined starting position of carriage advance and to move the grinding wheel away from the work prior to reversal of the carriage toward home position.

15. The machine of claim 14 further characterized in that said tool head is pivotable to swing sidewise from a relatively centered no-angle position to selected positions crosswise of the spindle axis for cross-cutting purposes; and there is further provided head-swinging means operative to move the head into pre-selected cross-cutting positions, said means including presettable digital to binary coding switch means with associated swing head logic to activate said head-moving means and shift said head one or more times during any duty cycle at a time when said carriage is withdrawn toward home position at least a distance which will remove the work from collision with the grinding wheel.

16. The machine of claim 1 wherein said motors are responsive in speed to voltage amplitude and a first one of said motors is driven by voltage manually adjustable to determine a velocity reference voltage and the second motor is driven under control of digitally-coded binary drive pulses converted to analogue voltage and operates in a servo mode with the frequency of said binary drive pulses regulated by supervisory pulse means generated in part by both motors and in part by presettable digital to binary coding ratio switch means and frequency-dividing means providing the aforesaid drive pulses.

17. The machine of claim 13 wherein said motors are responsive to voltage amplitude and are driven in a servo relationship with a first one of the motors driven by manually adjustable velocity reference voltage, and the second motor driven from analogue voltage means comprising an up-down counter reversely driven by drive pulses originating from presettable digital to binary coding ratio switch means in conjunction with frequency-dividing means and servo-regulating pulses generated by said first motor producing drive pulses applied to said up-down counter, said second motor including pulse generating means applying regulatory pulses to said up-down counter whereby the angular position of the drive shaft of said second motor is maintained in predetermined relationship to the angular position of the drive shaft of said first motor and the speed ratio of the two motors is adjustable through a predetermined working range by changing the digital values of said ratio switch means alone, said velocity reference voltage being nevertheless adjustable to maintain such reference voltage at a desired and relatively fixed reference value.

18. A spiral grinding machine including a reciprocable carriage slide and a work spindle carried thereby for travel relative to a grinding tool in successive working passes from a home starting position of the carriage to predetermined advanced stopping positions; first motor means operative to travel the carriage slide between said positions; first circuit means operative to cause said first motor means to drive said carriage slide to make a preselected number of working passes; second motor means operative to rotate said spindle during carriage travel as aforesaid; second circuit means operative to stop said spindle rotation for indexing on arrival of the carriage slide at said advanced position and to restart said spindle in indexed rotation prior to advance of the carriage slide in each succeeding working pass a distance which would bring the work into reengagement with said grinding tool; third circuit means operative to index the work spindle by restarting rotation thereof in steps aggregating a predetermined angular index amount in each working pass following the first and following the time of stoppage of the spindle rotation as aforesaid, but prior to the arrival of the carriage slide at such a position as would cause the work to reengage said tool before said indexing rotation is completed; and fourth circuit means including an indexing switch presettable to determine the number of said aggregate spindle indexing steps required to reengage the work with the grinding tool at a point exactly equivalent to said predetermined angular index amount.

19. A machine for abrading and grinding of the type in which a rotary work spindle is carried between predetermined starting and working positions by a reciprocable carriage to travel work carried by the spindle relative to an abrading, grinding or the like tool, and in which means is provided for automatically indexing the spindle to predetermined angular index positions to start the work in one or more additional working passes in predetermined angular index positions, characterized in that the spindle and carriage are driven by corresponding pulse-controlled motors actuated by circuit means operative to predetermine the number of times the carriage is to move to and from a predetermined advanced working position and the number of times the work spindle is to be indexed, together with the relative speed ratios of spindle and carriage movement in the forward working advance, at least; said circuit means being further operative to stop the spindle on each arrival of the carriage at a preselected forward working position and thereupon to effect withdrawal of the carriage from said forward position substantially, concomitantly with such stoppage and restarting of the carriage toward working position for a preset number of additional index passes; together with indexing subcircuit means including index distance control and pass means operative to restart rotation of the spindle in step with the carriage position in each indexing operation, whereby the work is presented to the tool in that angular position thereof which is exactly at the preset index position.

20. An abrading and grinding machine as characterized in claim 19 further characterized by inclusion of further subcircuit means having adjustable speed control means operative automatically in the reverse travel phase of the carriage movements from advanced forward working position as aforesaid to increase the reverse speed of the carriage whereby the time required for indexing the work is reduced.

* * * * *